US012325494B2

(12) United States Patent
Browne et al.

(10) Patent No.: US 12,325,494 B2
(45) Date of Patent: Jun. 10, 2025

(54) MOORING ROBOT

(71) Applicant: Ipalco BV, Rotterdam (NL)

(72) Inventors: Patrick Browne, Christchurch (NZ); Peter Worley, Lincoln (NZ); Stephen Topliss, Christchurch (NZ)

(73) Assignee: Ipalco B.V., Rotterdam (NL)

( * ) Notice: Subject to any disclaimer, the term of this patent is extended or adjusted under 35 U.S.C. 154(b) by 422 days.

(21) Appl. No.: 17/780,807

(22) PCT Filed: Nov. 27, 2020

(86) PCT No.: PCT/IB2020/061199
§ 371 (c)(1),
(2) Date: May 27, 2022

(87) PCT Pub. No.: WO2021/105932
PCT Pub. Date: Jun. 3, 2021

(65) Prior Publication Data

US 2022/0411024 A1 Dec. 29, 2022

(30) Foreign Application Priority Data

Nov. 28, 2019 (AU) ..... 2019904497

(51) Int. Cl.
*B63B 21/00* (2006.01)
*B63B 59/02* (2006.01)

(52) U.S. Cl.
CPC ..... *B63B 21/00* (2013.01); *B63B 59/02* (2013.01); *B63B 2021/006* (2013.01)

(58) Field of Classification Search
CPC ..... B63B 21/00; B63B 2021/001; B63B 2021/002; B63B 2021/003;
(Continued)

(56) References Cited

U.S. PATENT DOCUMENTS 4,137,861 A 2/1979 Brummenaes
6,938,570 B2 * 9/2005 Montgomery ..... E02B 3/24 114/230.1

(Continued)

FOREIGN PATENT DOCUMENTS

EP 2 450 271 A2 5/2012
JP 2000-230225 A 8/2000

(Continued)

*Primary Examiner* — Daniel V Venne
(74) *Attorney, Agent, or Firm* — Muncy, Geissler, Olds & Lowe, P.C.

(57) ABSTRACT

A mechanism suitable to moor and/or connect, engage, fender, or couple a vessel to a terminal such a dock, wharf, pier, pontoon, floating structure, off-shore structure, or another vessel. Typically, mechanism is used in a mooring robot or fender and will comprises a base, the mechanism dependent from the base and supporting an element remote the base. The element may be configured as a fender element or attachment element. The extension mechanism forms part of sarrus mechanism formed of the base, extension mechanism, and attachment element. The sarrus mechanism allows the attachment element to extend linearly transversely from the base in the sway direction. The use of a sarrus mechanism allows for a compact footprint design, that is also very stable in the surge and heave directions.

13 Claims, 22 Drawing Sheets

(58) Field of Classification Search
CPC ..... B63B 2021/004; B63B 2021/006; B63B 59/02; B25J 15/0616; B25J 18/02; E02B 3/26; Y02A 30/30
USPC ..... 114/230.1, 230.17
See application file for complete search history.

(56) References Cited

U.S. PATENT DOCUMENTS

| | | | | |
|---|---|---|---|---|
| 7,055,448 | B2 * | 6/2006 | Hadcroft | B63B 21/00 114/230.1 |
| 7,293,519 | B2 | 11/2007 | Montgomery et al. | |
| 8,408,153 | B2 * | 4/2013 | Montgomery | E02B 3/20 114/230.17 |
| 2004/0154518 | A1 * | 8/2004 | Hadcroft | B63B 21/00 114/230.1 |

FOREIGN PATENT DOCUMENTS

| | | | |
|---|---|---|---|
| WO | WO 01/62585 | A1 | 8/2001 |
| WO | WO 2010/053368 | A1 | 5/2010 |

* cited by examiner

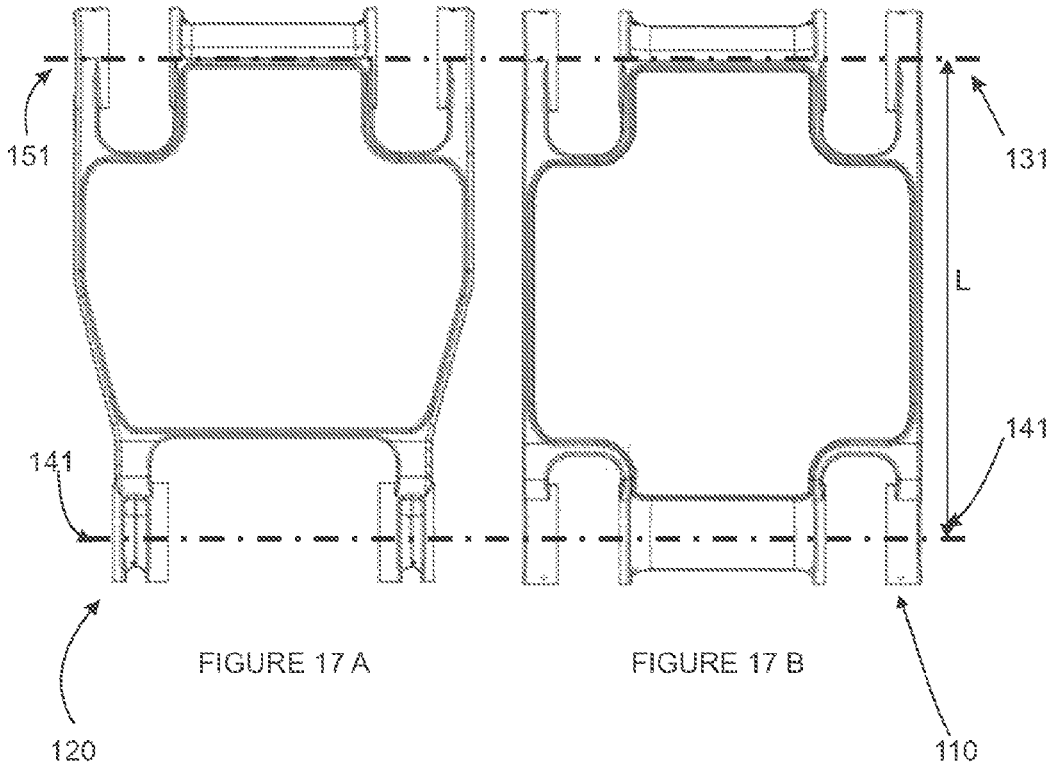
FIGURE 17 A
FIGURE 17 B
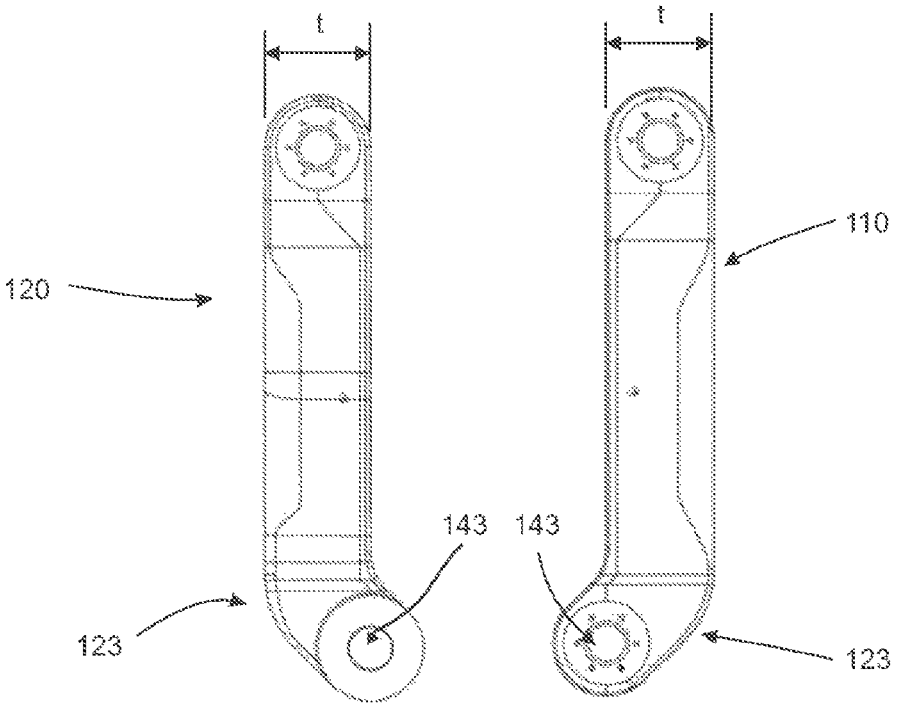
FIGURE 17 C
FIGURE 17 D

MOORING ROBOT

CROSS REFERENCE TO RELATED APPLICATIONS

This application is a National Stage of International Application No. PCT/IB2020/061199, filed on Nov. 27, 2020, for which priority is claimed under 35 U.S.C. § 120; and this application claims priority of application No. 2019904497 filed in Australia on Nov. 28, 2019 under 35 U.S.C. § 119; the entire contents of both of which are hereby incorporated by reference.

The present invention relates to a mooring robot. More particularly but not exclusively it relates to a mooring robot to be fixed to a dock, utilising a sarrus mechanism to extend and retract a vacuum pad towards and away from the dock to engage an adjacent vessel to be connected or moored.

BACKGROUND

Mooring devices such as mooring robots are well known in the art. An example of such devices is disclosed by the patent publications WO2001/62585, EP2540271, and WO2001/62585. Such mooring devices are used to engage with and hold a vessel to a terminal such as a wharf at a port. Such mooring devices may typically comprise means for engaging and holding approaching vessels, such as vacuum pads. The vacuum pads are moved on arms or arm linkages from a base of the mooring robot.

The use of the systems and mooring robots described above typically includes docking the ship alongside a docking terminal along which a plurality of mooring robots are stationed. The mooring robots can extend and retract a vacuum pad that is to engage with the vessel being docked. Once the mooring robot has its vacuum pad engaged with the side of the vessel, the vacuum pads are actuated, which hold fast against a side surface of the vessel by creating a suction to the vessel, thereby ensuring that the vessel is securely moored to the docking terminal.

The arms or arm linkages of current mooring robots may be clunky and utilise excess dock space. The required footprint on the dock of existing mooring robots can be large, and/or the allowable extension and retraction distance of the vacuum pad may not be sufficient for the needs, or could be greater. The arms or arm linkages of mooring robots need to be strong to withstand the operational forces. In some cases, other elements are required to support the weight of the arms or arm linkages. These other elements may incur more manufacturing cost. In some cases the arms or arm linkages require moving arrangements, such as hydraulics or cable systems to extend and/or retract them. These hydraulics may need to be large enough to move both the arms or arm linkages in the transverse direction, as well as hold at least some of the weight of the arms or arm linkages themselves.

In this specification, where reference has been made to external sources of information, including patent specifications and other documents, this is generally for the purpose of providing a context for discussing the features of the present invention. Unless stated otherwise, reference to such sources of information is not to be construed, in any jurisdiction, as an admission that such sources of information are prior art or form part of the common general knowledge in the art.

It is an object of the present invention to provide a mooring robot that overcomes or at least partially ameliorates some of the abovementioned disadvantages or which at least provides the public with a useful choice.

STATEMENTS OF INVENTION

In a first aspect the present invention may be said to consist in a mooring robot for releasably fastening a vessel to a dock or to a second vessel, the mooring robot comprising:

a. a base to be attached to said dock or second vessel;

b. an attachment element configured to be releasably engageable with a surface of said vessel; and c. at least two linkages dependent from the base and together supporting the attachment element and configured to retract and extend to allow movement of the attachment element in a direction (herein after "transverse direction") towards and away from the base; each linkage comprising a base arm and an attachment arm pivotably connected together at a revolute intermediate joint, the base arm pivotably connected to the base at a revolute base joint and the attachment arm pivotably connected to the attachment element at a revolute attachment joint, wherein the three joints (revolute intermediate joint, the revolute base joint, and the revolute attachment joint) each define a rotational axis that are spaced apart and parallel to each other; wherein the rotational axes of the three joints of a first linkage of the at least two linkages are not parallel to rotational axes of the three joints of at least one second linkage of the at least two linkages.

In one embodiment, wherein the moving arrangement operatively acts between the base and the attachment element directly or indirectly.

In one embodiment, the moving arrangement is configured to extend and retract the attachment element in the transverse direction.

In one embodiment, the rotational axis at the intermediate joint is herein after referred to as the intermediate rotational axis; the rotational axis at base joint is herein after referred to as the base rotational axis; and the rotational axis at the attachment joint is herein after referred to as the attachment rotational axis.

In one embodiment, the base is fixed or movable relative to said dock or second vessel.

In one embodiment, the robot comprises three to six, or more of said linkages.

In one embodiment, the robot comprises only two of said linkages; the first linkage and the second linkage.

In one embodiment, for each said linkage the arms are the same length as each other.

In an alternative embodiment, for each said linkage the arms are different lengths to each other.

In one embodiment, an angle intermediate the rotational axis of the first linkage is at 90 degrees to the intermediate rotational axis of the second linkage (i.e the rotational axes are orthogonal each other).

In one embodiment, an angle between the intermediate rotational axes of two said linkages is between 5 and 175 degrees.

In one embodiment, the angle between the intermediate rotational axes of two said linkages is between 40 and 150 degrees.

In one embodiment, the angle between the intermediate rotational axes of two said linkages is between 90 and 130 degrees.

In one embodiment, the angle between the intermediate rotational axes of two said linkages is 100 degrees.

In one embodiment, the angle between the intermediate rotational axes of two said linkages is 120 degrees.

In one embodiment, the linkages transfer the majority of the weight of the attachment element to said dock or second vessel e.g. via the base.

In one embodiment, only the linkages transfer the weight of the attachment element said dock or second vessel e.g. via the base.

In one embodiment, the base arm and attachment arm of at least one of the linkages can rotate up to 180 degrees relative each other, or at least until the rotational axes of the joints are on or close to being on the same plane.

In one embodiment, for each linkage the intermediate joint has a maximum rotational angle of 180 degrees.

In one embodiment, each linkage cannot extend past over-centre; or at least cannot extend past a configuration where the rotational axes of the joints are all on the same plane; or cannot extend past a configuration where the distance between the base rotational axis is at a maximum distance away from the attachment rotational axis; or the intermediate rotational axis cannot extend past a notional plane that both the base rotational axis and attachment rotational axis lie on.

In one embodiment, at least one linkage is configured to extend the attachment element under gravity.

In one embodiment, the intermediate joint of at least one linkage moves downwards when the linkage mechanism extends.

In one embodiment, at least one linkage is biased to retract the attachment element under gravity.

In one embodiment, the intermediate joint of at least one linkage moves downwards when the linkage mechanism retracts.

In one embodiment, both intermediate joints moves downwards when the linkage mechanism extends.

In one embodiment, both intermediate joints moves downwards when the linkage mechanism retracts.

In one embodiment, at least one linkage is self-retracting due to gravity.

In one embodiment, two intermediate rotational axes form a notional 'V' pointing downwards.

In one embodiment, two intermediate rotational axes form a notional 'V' pointing upwards.

In one embodiment, the moving arrangement is a powered actuating arrangement.

In one embodiment, the moving arrangement is a passive moving arrangement, configured to resist movement of the frame in the transverse direction.

In one embodiment, the moving arrangement is a powered actuating arrangement configured to actively drive the attachment element in the transverse direction.

In one embodiment, the moving arrangement comprises one or more selected from a hydraulic actuator, an electric actuator, a chain drive system, and belt drive system.

In one embodiment, the moving arrangement is engaged between the base and one or more of the attachment arms.

In one embodiment, the moving arrangement is configured as a tricep drive defined by an extension extending off the end of the one or more attachment arms at the end distal from the attachment element, and an actuator engaged and extending between a distal end of the extension and the base.

In one embodiment, the extension extends past the respective intermediate joint.

In one embodiment, the moving arrangement is engaged between the base and the attachment element.

In one embodiment, the moving arrangement comprises one or more hydraulic actuators.

In one embodiment, the moving arrangement comprises compound hydraulic actuators.

In one embodiment, the compound hydraulic actuators are configured to extend and retract e.g. in the transverse direction or to cause the linkage to extend and retract.

In one embodiment, the moving arrangement comprises hydraulic and/or electric rotary motors located at one or more joints of one or more linkages.

In one embodiment, the moving arrangement comprises hydraulic and/or electric rotary motors in combination with a direct drive or tricep drive.

In one embodiment, the at least two linkages, base, and attachment element form a sarrus linkage.

In one embodiment, the attachment element comprises an engagement element configured to engage a surface of the vessel.

In one embodiment, the engagement element is a vacuum pad, vacuum cup or cups, hook device, a charging connection, or other engagement feature configured to releasably engage with a vessel.

In one embodiment, the attachment element comprises a sliding mechanism intermediate the engagement element and the linkages.

In one embodiment, the sliding mechanism comprises at least one selected from a substantially vertical elongate guide configured to allow the engagement element to raise and lower with respect to the base; and a substantially horizontal elongate guide configured to allow the engagement element to move fore and aft with respect to the base.

In one embodiment, the sliding mechanism engages with the linkages.

In one embodiment, the sliding mechanism allows passive movement of the engagement element.

In one embodiment, the sliding mechanism allows powered movement of the engagement element.

In one embodiment, the actuating means is engaged between the base and the sliding mechanism.

In one embodiment, the sliding mechanism element comprises a frame.

In one embodiment, the actuating means is engaged between the base and the frame.

In one embodiment, the rotational connection comprises one or more multi rotational axis joints in line with each other that act as a revolute joint in combination.

In one embodiment, the arms are substantially wide.

In one embodiment, the arms are generally rectangular cuboid shaped.

In one embodiment, the extending and retracting movement of the attachment element in a transverse direction is a straight line movement.

In one embodiment, the extending and retracting movement of the attachment element is purely in a transverse direction.

In one embodiment, the extending and retracting movement of the attachment element is purely in a transverse direction, without any movement of the sliding mechanism.

In one embodiment, the revolute joints are pin joints.

In one embodiment, the revolute joints are elongate pin and socket joints.

In one embodiment, the arms are cast.

In one embodiment, the linkages can support an attachment element over 100 kg.

In one embodiment, the attachment arm and base arm of a linkage can abut flush against each other when fully retracted.

In one embodiment, the linkages weigh over 500 kg.

In one embodiment, the arms are elongate.

In one embodiment, the arms comprise a first and second end, the second end at or near the intermediate joint.

In one embodiment, the arms are substantially straight between their first and second ends.

In one embodiment, the base arms are substantially straight between their first and second ends.

In one embodiment, one of both of the attachment arm and base arm comprise a L shape at their second end.

In one embodiment, the L shape allows the attachment arm to fold flush with the respective base arm of the same linkage when retracted.

In one embodiment, the linkages fully support the weight of the attachment element, when both retracted and extended.

In one embodiment, a maximum extension distance of the attachment element from the base is equivalent to a combined length of the arms minus the overlap of the arms at forming the intermediate joint.

In one embodiment, a minimum retraction distance of the attachment element from the base is equivalent to a thickness of the base arm and a thickness of the attachment arm combined.

In one embodiment, the engagement element's most outward (vessel facing) surface is planar with the dock's most outward (vessel facing) surface, when the extension mechanism is fully retracted.

In one embodiment, the rotational axes of the base joints are on the same plane as each other.

In one embodiment, the rotational axes of the intermediate joints are on the same plane as each other.

In one embodiment, the rotational axes of the attachment joints are on the same plane as each other.

In one embodiment, the common rotational axes of each linkage, lie on the same vertical plane, or plane orthogonal to the direction of extension.

In one embodiment, the rotational axes of the base joints intersect.

In one embodiment, the rotational axes of intermediate joints intersect.

In one embodiment, the rotational axes of the attachment joints intersect.

In one embodiment, the common rotational axes of each linkage intersect.

In one embodiment, the base is engaged to a moveable arrangement located on the dock to allow vertical and or horizontal movement of the base.

In one embodiment the base is attached to said dock or second vessel;

In one embodiment the attachment element is releasably engaged with a surface of said vessel.

In one embodiment only the at least two linkages dependent from the base vertically support the attachment element.

In one embodiment, the arms of a linkage are different lengths.

In one embodiment, the rotational axes of two base joints are out of plane to each other.

In one embodiment, the rotational axes of two attachment joints are out of plane to each other.

In one embodiment, a linkage's attachment joint's rotational axis is not at the same height or level as the base joint's rotational axis.

In one embodiment, a linkage's attachment joint's rotational axis is offset in the direction along the rotational axis the base joint's rotational axis.

In a second aspect the present invention may be said to consist in a mooring robot for releasably fastening a vessel to a dock or to a second vessel, the mooring robot including:

a base to be attached to the dock or second vessel;

an attachment element releasably engageable to said vessel;

a frame to retain the attachment element;

a sarrus mechanism comprised of the base, frame and at least two linkages intermediate the base and frame to allow extending and retracting of the frame in a transverse direction away and towards the base; and a moving arrangement for causing at least one of said extending and retracting.

In one embodiment, each linkage comprises a respective base arm and an attachment arm.

In one embodiment, each linkage comprises three revolute joints to allow rotation between the base and base arm; the base arm and attachment arm; and attachment arm and attachment element.

In one embodiment, the rotational axes of the three revolute joints of a linkage are parallel to each other.

In one embodiment, the rotational axes of the three revolute joints of a first linkage are not parallel to the rotational axes of the three revolute joints on the second linkage.

In one embodiment, the moving arrangement is a hydraulic actuator configured to drive the frame in the transverse direction.

In one embodiment, the frame is engaged to a sliding mechanism, and the sliding mechanism retains the engagement element.

In one embodiment, the sliding mechanism comprises at least one selected from a substantially vertical elongate guide configured to allow the engagement element to raise and lower with respect to the base; and a substantially horizontal guide configured to allow the engagement element to move fore and aft with respect to the base.

In one embodiment, the linkages support at least the weight of the frame and attachment element.

In a third aspect the present invention may be said to consist in a mooring robot for engaging with a vessel, the mooring robot comprising:

a base to be attached to a dock or second vessel, an engagement element configured to be releasably engageable with a surface of said vessel;

at least two linkages dependent from the base and supporting the engagement element and configured to allow movement of the engagement element in a transverse direction towards and/or away from the base; each linkage comprising a base arm and an attachment arm pivotably connected together by a revolute intermediate joint, the base arm pivotably connected to the base at a revolute base joint and the attachment arm pivotably connected to the attachment element at a revolute attachment joint, wherein the rotational axes of the three joints are parallel to each other, and the rotational axes of the joints of a first linkage of the at least two linkages are not parallel to rotational axes of the joints of a second linkage of the at least two linkages, and a moving arrangement configured to extend and retract the engagement element in the transverse direction.

In one embodiment, the engagement element is a vacuum pad, a vacuum cup or cups, a hook device, a magnetic coupling, a charging connection, a fluid connection, or other engagement feature to releasably engage with a vessel.

In a fourth aspect the present invention may be said to consist in a mooring robot for releasably engage to a vessel to a dock or to a second vessel, the mooring robot including:

a. a base to be attached to the dock or second vessel;

b. an attachment element releasably engageable to said vessel;

c. a frame to retain the attachment element;

d. a sarrus mechanism established by the base, frame and at least two linkages intermediate the base and frame to allow extending and retracting of the frame in a direction (herein after "transverse direction") away and towards the base; and e. a moving arrangement for driving movement of the frame away from the base.

In a fifth aspect the present invention may be said to consist in a mechanism for engaging or fendering of a vessel to a dock or to a second vessel, the mechanism including:

a. a base to be attached to the dock or second vessel;

b. an element contactable to said vessel;

c. a frame to retain the element;

d. at least two linkages intermediate the base and frame to form a sarrus mechanism in combination with the base and frame, the sarrus mechanism allowing extending and retracting movement of the frame in a transverse direction respective to the base, wherein a first linkage comprises rotational axes non-parallel like rotational axes of second linkage; and e. a moving arrangement for driving and/or resisting movement of the frame in said transverse direction.

In one embodiment, each linkage of the at least two linkages comprises a respective base arm and an attachment arm.

In one embodiment, each linkage comprises three revolute joints to allow rotation between the base and base arm; the base arm and the attachment arm; and the attachment arm and the frame.

In one embodiment, each revolute joint comprises a rotational axis, and the three rotational axes of a linkage are parallel to each other and wherein the rotational axes of the three revolute joints of a first linkage are not parallel to the rotational axes of the three revolute joints on the second linkage.

In one embodiment, the moving arrangement is hydraulic actuator configured to drive the frame in the transverse direction, or the moving arrangement is an energy absorber.

In one embodiment, the linkages support at least a weight of themselves and at least a partial amount of weight of the element. In a sixth aspect the present invention may be said to consist in a mechanism for a fender between a vessel and dock or second vessel, or a mooring robot for releasably fastening a vessel to a dock or to a second vessel, the mechanism comprising:

a) a base to be attached to said dock or second vessel;

b) an element configured to be either a fender element or an attachment element releasably engageable with a surface of said vessel; and c) at least two linkages dependent from the base and together and at least partially supporting the element and configured to retract and extend to allow movement of the element in a direction (herein after "transverse direction") towards and away from the base respectively; each linkage comprising a base arm and an attachment arm pivotably connected together at a revolute intermediate joint, the base arm pivotably connected to the base at a revolute base joint and the attachment arm pivotably connected to the element at a revolute attachment joint, wherein the three joints each define a rotational axis that are spaced apart and parallel to each other wherein the rotational axes of the joints of a first linkage of the at least two linkages are not parallel to rotational axes of the joints of at least one second linkage of the at least two linkages.

In one embodiment, the mechanism comprises a moving arrangement configured to extend and/or retract the attachment element in the transverse direction.

In one embodiment, the mechanism comprises three, four, five, or six linkages.

In one embodiment, the robot comprises two linkages; the first linkage and the second linkage.

In one embodiment, an angle between the intermediate rotational axis of the first linkage is at 90 degrees to the intermediate rotational axis of the second linkage (i.e the rotational axes are orthogonal each other).

The mechanism as claimed in claim 6, wherein the angle between two intermediate joint rotational axes of the two linkages is between 90 and 130 degrees.

In one embodiment, only the linkages transfer the weight of the element to said dock or second vessel.

In one embodiment, at least one linkage is biased to retract the element under gravity.

In one embodiment, the moving arrangement is a powered actuating arrangement.

In one embodiment, the moving arrangement is a powered actuating arrangement configured to actively drive the element in the transverse direction.

In one embodiment, the moving arrangement is a passive actuating arrangement configured to passively drive the element in the transverse direction.

In one embodiment, the moving arrangement only provides movement in the transverse direction.

In one embodiment, the moving arrangement is an energy absorber, and/or where the energy absorber is one or more selected from a rubber absorber, pneumatic absorber and foam absorber.

In one embodiment, the moving arrangement comprises one or more selected from a hydraulic actuator, an electric actuator, a chain drive system, and belt drive system.

In one embodiment, the moving arrangement is engaged between the base and one of the attachment arm and the base arm.

In one embodiment, the moving arrangement is engaged between the base and the element.

In one embodiment, the moving arrangement comprises one or more hydraulic actuators.

In one embodiment, the moving arrangement comprises compound hydraulic actuators.

In one embodiment, the compound hydraulic actuators are configured to extend and retract and/or to cause the linkage to extend and retract.

In one embodiment, the element comprises an engagement element configured to engage a surface of the vessel, and the engagement element is a vacuum pad, vacuum cup or cups, hook device, a charging connection, or other engagement feature configured to releasably engage with said vessel.

In a seventh aspect the present invention may be said to consist in a fender for between a vessel and dock or second vessel, the fender comprising:

a) a base to be attached to said dock or second vessel;

b) an element to be contactable with a surface of said vessel;

c) at least two linkages dependent from the base and together supporting the element and configured to retract and extend to allow movement of the element in a direction (herein after "transverse direction") towards and away from the base respectively; each linkage comprising a base arm and an attachment arm pivotably connected together at a revolute intermediate joint, the base arm pivotably connected to the base at a revolute base joint and the attachment arm pivotably connected to the element at a revolute attachment joint, wherein the three joints each define a rotational axis that are spaced apart and parallel to each other, and wherein the rotational axes of the joints of a first linkage of the at least two linkages are not parallel to rotational axes of the joints of at least one second linkage of the at least two linkages, and d) an energy absorber comprising a proximal end connected to either or both of the a) base, and b) dock or second vessel, and a distal end connected to either or both of i) the attachment arm or one or both of the first linkage and second linkage and ii) the element.

In an eighth aspect the present invention may be said to consist in a mechanism for a fender between a vessel and dock or second vessel, or a mooring robot for releasably fastening a vessel to a dock or to a second vessel, the mechanism comprising:

a) a base to be attached to said dock or second vessel;

b) an element to be contactable with a surface of said vessel;

c) at least two linkages dependent from the base and together at least partially supporting the element and configured to retract and extend to allow movement of the element in a direction (herein after "transverse direction") towards and away from the base respectively; each linkage comprising a base arm and an attachment arm pivotably connected together at a revolute intermediate joint, the base arm pivotably connected to the base at a revolute base joint and the attachment arm pivotably connected to the element at a revolute attachment joint; and wherein movement of the element towards and/or away from the base follows a straight path.

In one embodiment, mechanism does not comprise a system utilising vectored control for maintaining said straight path.

In one embodiment, the straight path is horizontal.

In one embodiment, the straight path is orthogonal a rotational axis of at least one of the revolute joints.

In one embodiment, movement of the element/linkage is due to impact (imparting of motion) from a vessel with the element.

In one embodiment, the element comprises a fender element configured to fend a surface of the vessel.

In one embodiment, the element comprises an engagement element configured to engage a surface of the vessel, and the engagement element is a vacuum pad, vacuum cup or cups, hook device, a charging connection, or other engagement feature configured to releasably engage with said vessel.

In one embodiment, the three joints each define a rotational axis that are spaced apart and parallel to each other wherein the rotational axes of the joints of a first linkage of the at least two linkages are not parallel to rotational axes of the joints of at least one second linkage of the at least two linkages In one embodiment, the element is an energy absorbing element comprising a proximal end and distal end, wherein the proximal end is restrained to either the dock, second vessel, or base and the distal end is restrained to one or more linkages at or towards the element and/or the element.

In one embodiment, the energy absorbing element at least partially supports the weight of the element.

In one embodiment, the mechanism resists shear movement in the energy absorbing element when the element is impacted by a vessel.

In one embodiment, mechanism resists vertical movement of the distal end of the energy absorbing element.

Other aspects of the invention may become apparent from the following description which is given by way of example only and with reference to the accompanying drawings.

As used herein the term "and/or" means "and" or "or", or both.

As used herein "(s)" following a noun means the plural and/or singular forms of the noun.

The term "vacuum" as used herein, is not necessarily a full vacuum but can be a partial vacuum.

The term "comprising" as used in this specification and claims means "consisting at least in part of". When interpreting statements in this specification and claims which include that term, the features, prefaced by that term in each statement, all need to be present but other features can also be present. Related terms such as "comprise" and "comprised" are to be interpreted in the same manner.

The entire disclosures of all applications, patents and publications, cited above and below, if any, are hereby incorporated by reference.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF THE FIGURES

The invention will now be described by way of example only and with reference to the drawings in which:

FIG. 17*a/b*: shows a top view of an attachment and base arm in isolation respectively.

FIG. 17*b/c*: shows a side view of an attachment and base arm in isolation respectively.

DETAILED DESCRIPTION

Figure 1:
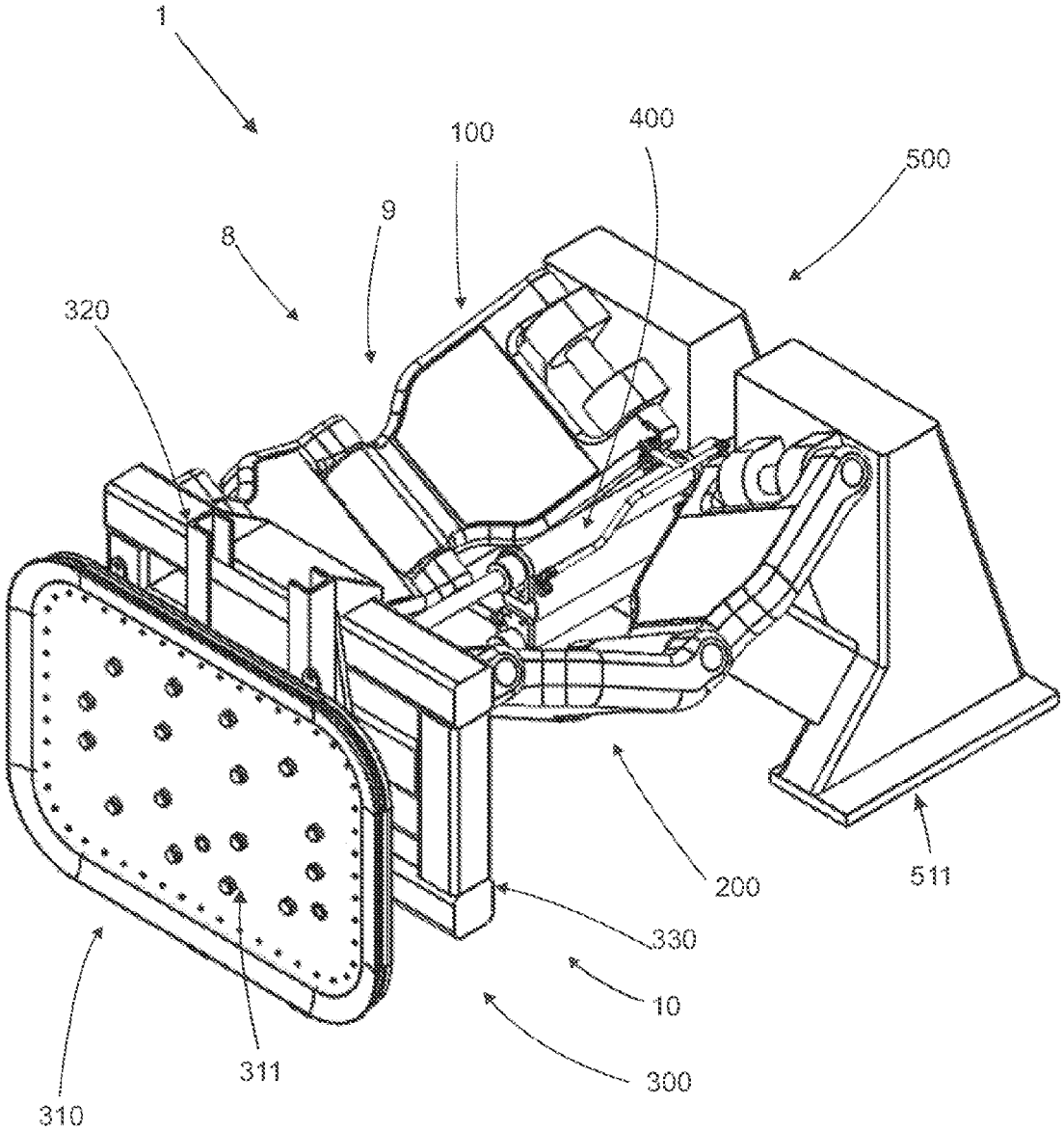
FIG. 1: shows a front top perspective view of a mooring robot in an extended position.

With reference to the above drawings, in which similar features are generally indicated by similar numerals, a mooring robot according to a first aspect of the invention is generally indicated by the numeral 1. When generally describing a linkage or linkages, the notation 9 is used. When describing features of the linkage 9 in this specification, the notation of the first linkage 100 will be used for clarity. A first linkage is referenced by the numeral 100 and second linkage by the numeral 200. Generally, the linkages are identical to each other, however in some embodiments they are different to each other. The features will generally be the same on a second linkage 200 and a third linkage etc, except the respective feature will be prefixed by the 200 or 300 notation. I.e. a base arm 110 of the first linkage 100, a base arm 210 of a second linkage 200.

According to the invention, there is provided a mooring robot 1, suitable to moor and/or connect, engage, fender, or couple a vessel 2 to a terminal 4 such a dock, wharf, pier, pontoon, floating structure, off-shore structure, or another vessel. The mooring robot 1 is used for purposes of fendering, mooring, or engaging an approaching vessel 2 to be fended, moored, or engaged to.

Typically, the mooring robot 1 will comprises a base 500, an extension mechanism 8 dependent from the base 500 and supporting an element at a distal region 10 remote the base 500. The element may be configured as a fender type element 701 (described later) or attachment element 300. The attachment element 300 will be described in detail first, however much of the description below may also relate to the fender element 701.

The attachment element 300 comprises an engagement element 310, such as at least one vacuum pad 311 or like engagement element 310, at a distal end 10 of the linkage 9. The extension mechanism 8 is used to extend the vacuum pad 311 towards a vessel 2 to be moored until it engages with the vessel 2, after which the vacuum pad 311 sucks onto the side 3 of the vessel 2 to secure the vessel 2 to the terminal 4, thereby mooring it. The vacuum pad 311 is moveable by means of the extension mechanism 8 in a range of extension in a transverse/sway direction (illustrated as arrow Y). The vacuum pad 311 can optionally also move in two further dimensions X and Z by a sliding mechanism 320 and/or moving arrangement 600, where X is a fore and aft/surge direction along the dock 4 and Z is a vertical/heave direction.

The extension mechanism 8 forms part of sarrus mechanism formed of the base 500, extension mechanism 8, and attachment element 300. The sarrus mechanism allows the attachment element 300 to extend linearly transversely from the base 500 in the sway direction Y. The weight of the attachment element 300 is almost fully, or fully, supported by the extension mechanism 8. The sarrus mechanism 8 or mechanism 8 may be used for mooring or acting as a fender to a vessel.

Figure 13A:
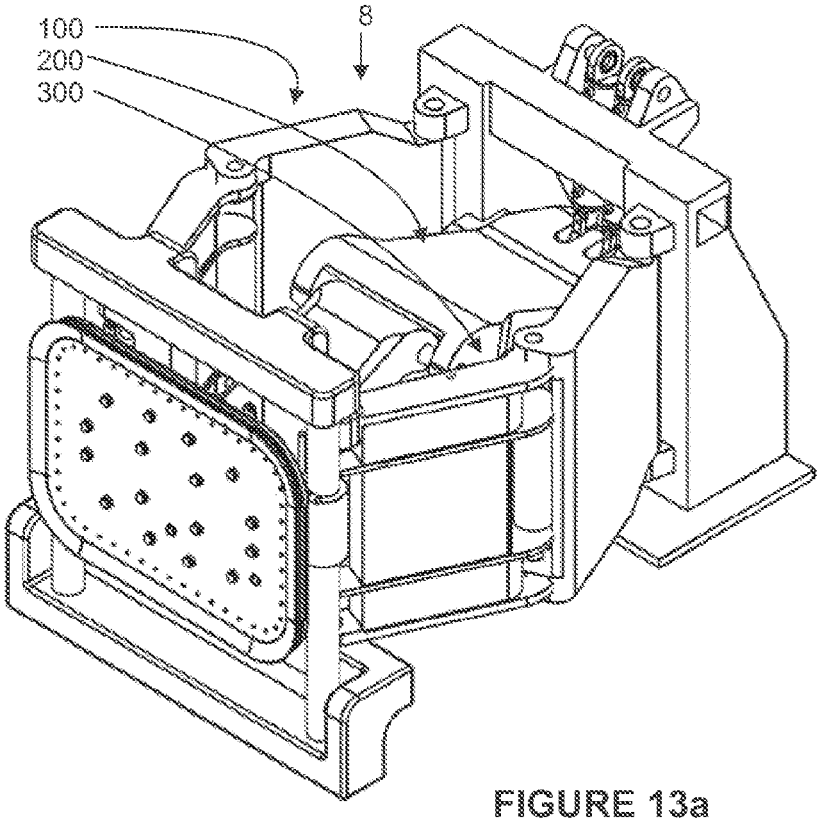
FIG. 13*a/b*: shows a front top perspective view of a mooring robot with a three linkage extension mechanism.
Figure 13B:
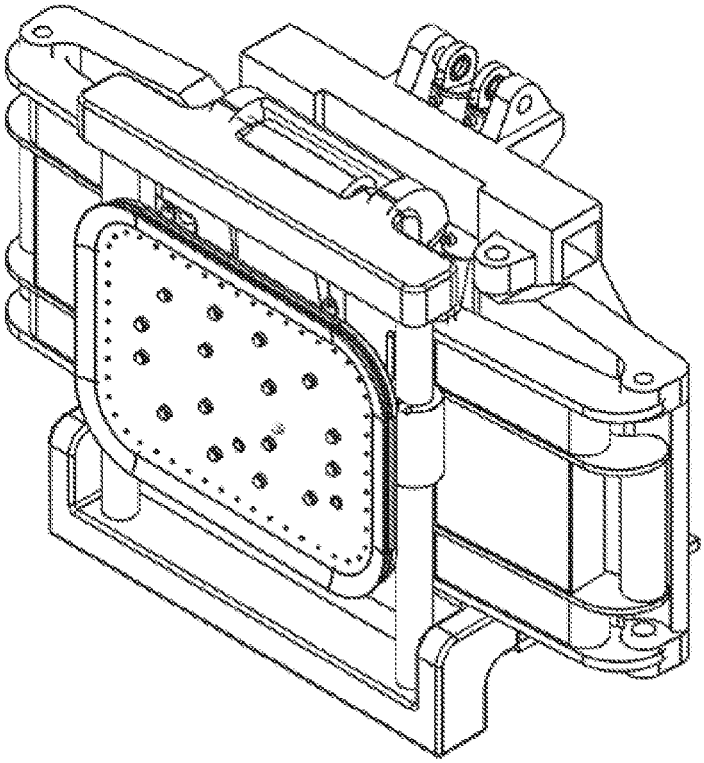

The extension mechanism 8 comprises two or more linkages 9. The linkages 9 are pivotably connected to both the base 500 and attachment element 300. To self-support the weight of the attachment element 300, there need to be at least two linkages 9. There may be more than two linkages 9, a three-linkage 9 extension mechanism 8 is shown in FIG. 13. Through most of this specification, the description will be based around an extension mechanism 8 with two linkages 9. However it is envisaged that a skilled person in the art will be able to modify the extension mechanism 8 to have more than two linkages 9 where operational use requires such.

In one embodiment, the linkage 100 comprises two arms; a base arm 110 and an attachment arm 120. The base arm 110 is respectively dependent from, and pivotably connected to the base 500 by base joint 130 having a respective base rotational axis 131. The attachment arm 120 is pivotably connected to the attachment element 300 at an attachment joint 150, having a respective attachment rotational axis 151. The base arm 110 and the attachment arm 120 are pivotably connected to each other at an intermediate joint 140, having an intermediate rotational axis 141. Each joint, i.e. the base joint 130, intermediate joint 140, and attachment joint 150 allow the pivotable movement between their respective features, i.e. base 500 to base arm 110; base arm 110 to attachment arm 120; and attachment arm 120 to the attachment element 300. Each joint 130, 140 and 150 may also be described as the three joints of a linkage 9.

Figure 3:
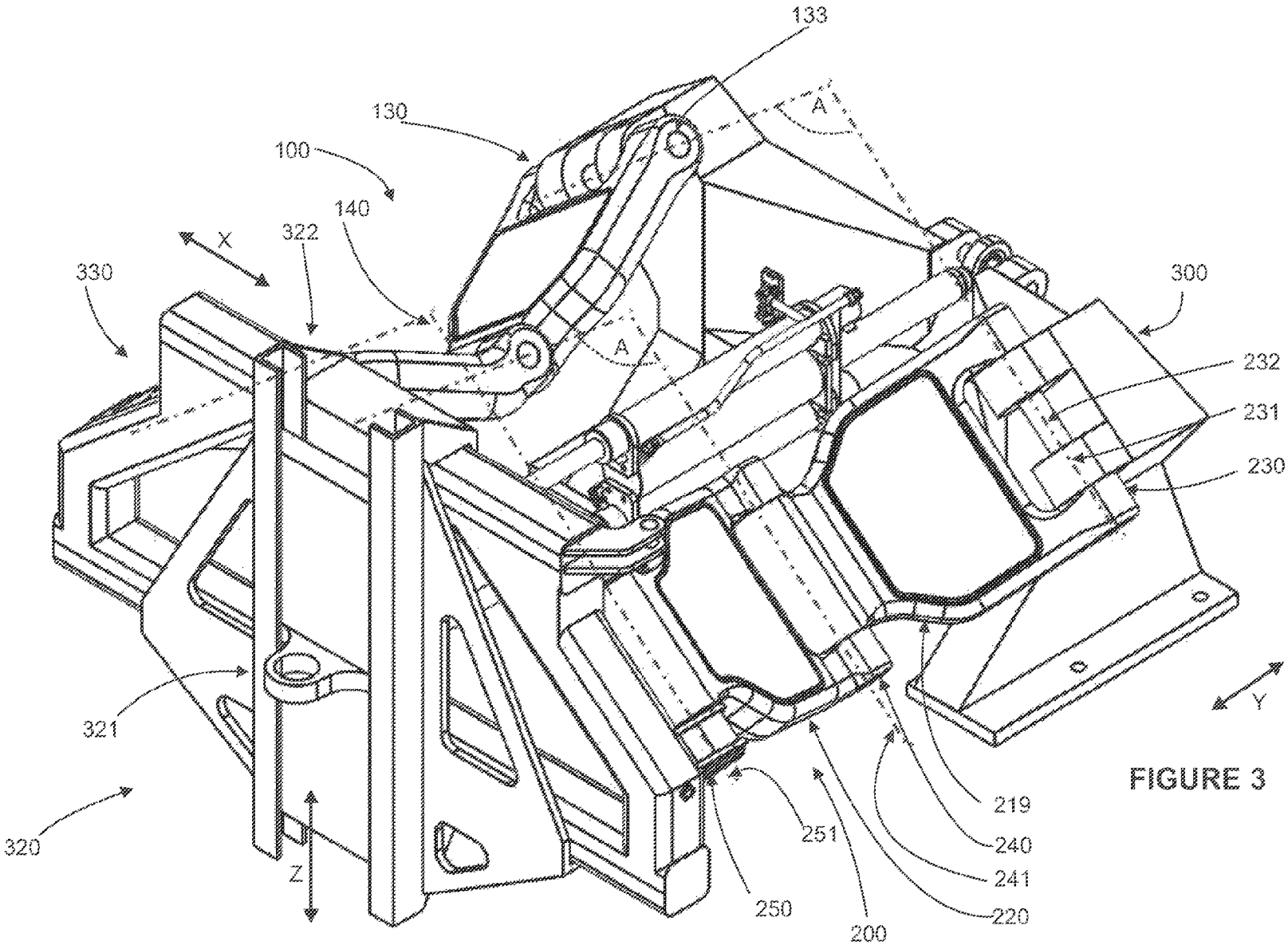
FIG. 3: shows a front top perspective view of a mooring robot in an extended position, without the engagement element.
Figure 4A:
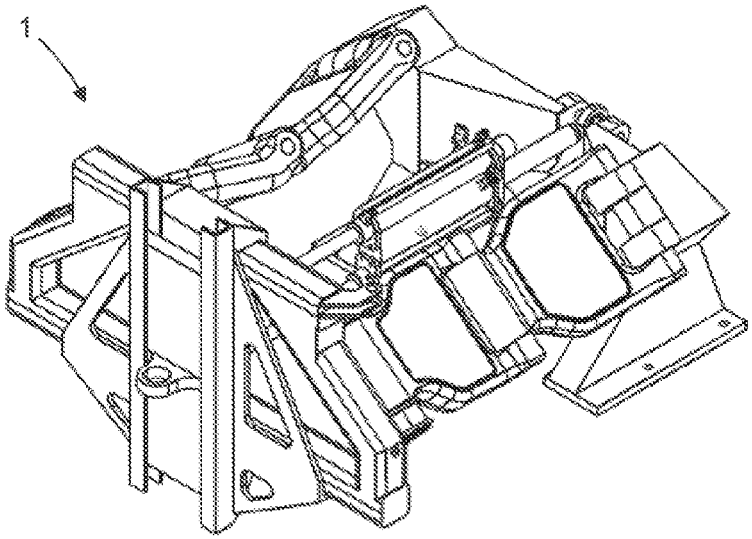
FIG. 4*a/b*: shows front top perspective views of the mooring robot of FIG. 3 in an extended and retracted position respectively.
Figure 4B:
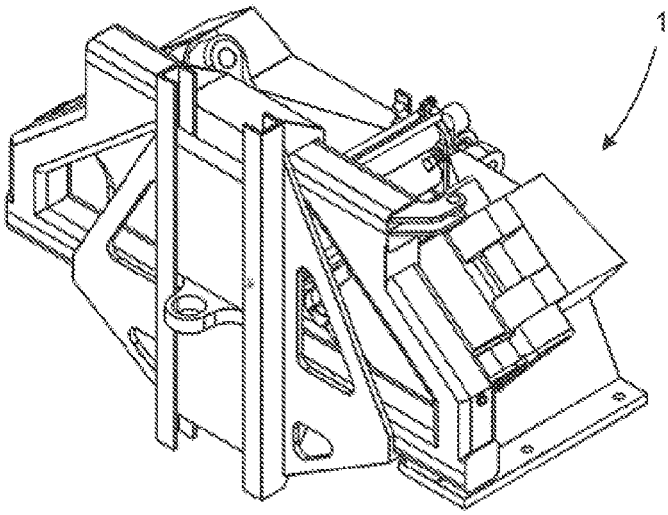
Figure 5A:
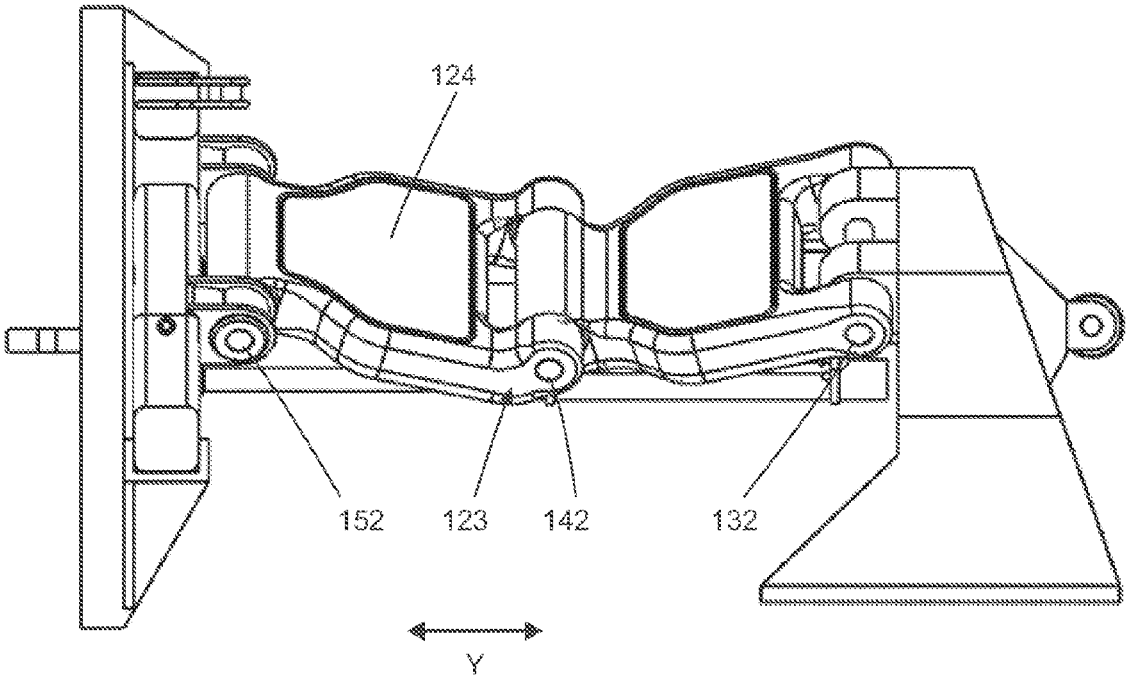
FIG. 5*a/b*: shows side views of FIG. 4*a*/4*b*.
Figure 5B:
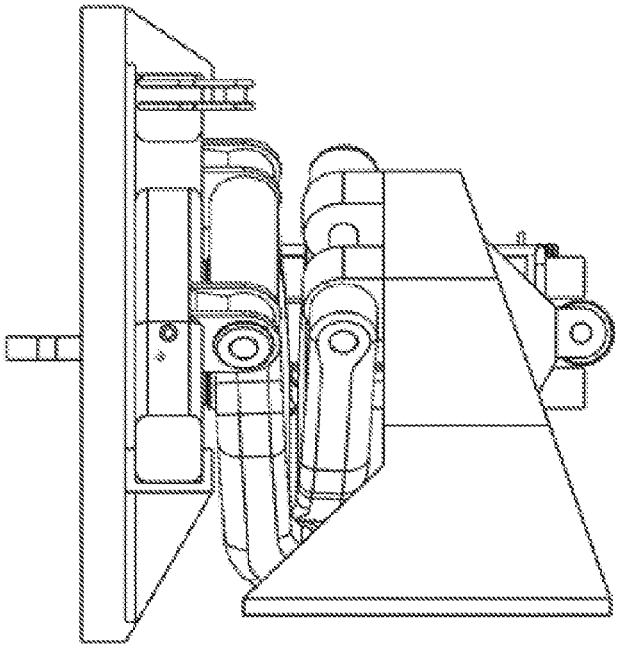

The attachment element 300 can be extended and retracted in the transverse direction Y by a moving arrangement 400. In some embodiment, the moving arrangement 400 is either a passive or an active moving arrangement. An example of a passive moving arrangement is a rubber damper or like resilient means, or the use of gravity to extend or retract the attachment element 300 depending on the configuration of the extension mechanism 8. A powered actuating arrangement 401 is shown in FIG. 3. In one embodiment, the powered actuating arrangement 401 comprises hydraulic actuators 402. Actuation of the hydraulic actuators 402 can extend the attachment element 300 in the transverse direction Y, by extending the extension mechanism 8 in the same direction. Likewise, the hydraulic actuators 402 can be actuated to retract and therefore retract the attachment element 300 in the transverse direction Y.

Preferably the attachment element 300 is fully supported in the heave direction Z by the extension mechanism 8. Preferably the extension mechanism 8 is not required to support the weight of the linkages 9 and the attachment element 300. In one embodiment the hydraulic actuator 402 can only provide a force in the transverse direction Y, and does not take any weight of the linkages 9 or attachment element 300 and the heave direction Z.

In combination, the base 500, attachment element 300, and the extension mechanism 8 that extends therebetween form a sarrus linkage/mechanism. A benefit of a sarrus linkage is that the extension mechanism can fully support the attachment element 300. A further benefit of a sarrus linkage is that the extension mechanism 8 can retract to a small distance compared to the distance it can extend. This allows the attachment element 300 to be drawn back and extend out a large distance. Further the extension mechanism 8 when retracted has the benefit of providing the mooring robot 1 with a small footprint on the dock, as the extension mechanism 8 is very compact when retracted. As will be known, a sarrus linkage has a number of configurations of linkages 9.

The use of two linkage mechanisms 9 is the preferred embodiment, however a three linkage 9 extension mechanism 8 is also shown in FIG. 13. Should space constraints, manufacturing costs, material advances, weight requirements, operational forces, and/or assembly techniques be changed; then the other linkage configurations, both in number of linkages and orientation of linkages, may become more or less viable.

The use of a two linkage 9 extension mechanism 8 is shown in most of the FIGS. 1 through 12. The two linkage 9 extension mechanism 8 may have the linkages 9 orientated in a number of different orientations. Furthermore, these differently orientated extension mechanism 8 may be moved by different configurations of moving arrangement 400.

Figure 11A:
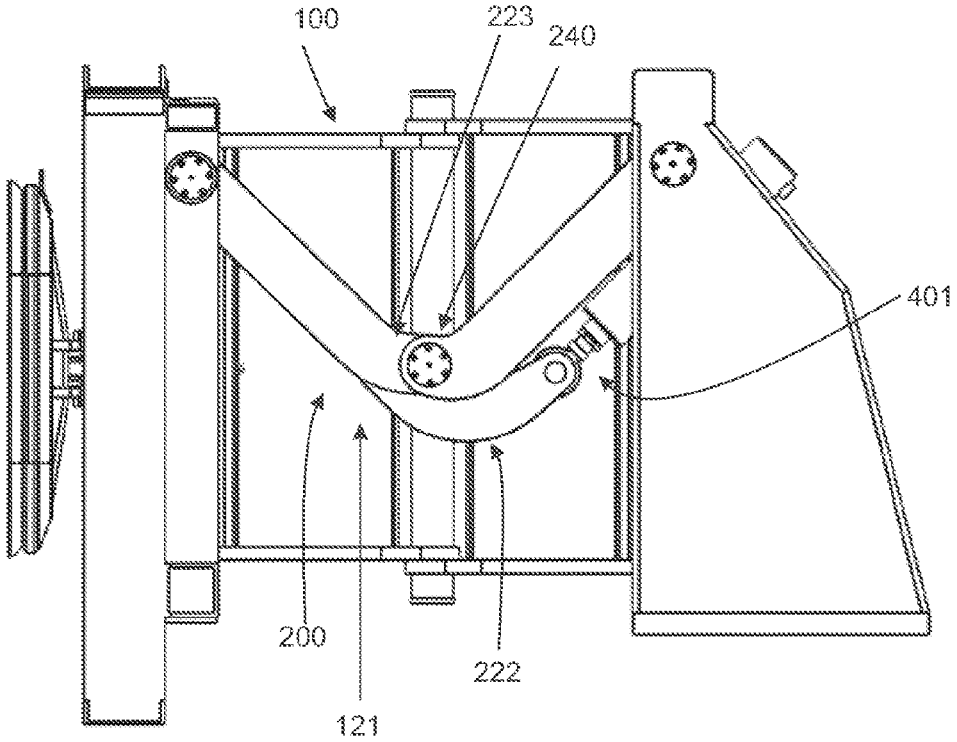
FIG. 11*a/b*: shows a front top perspective view of a mooring robot with an orthogonal extension mechanism, in the v type orientation, in the extended and protracted position respectively, configured for a tricep drive moving arrangement.
Figure 11B:
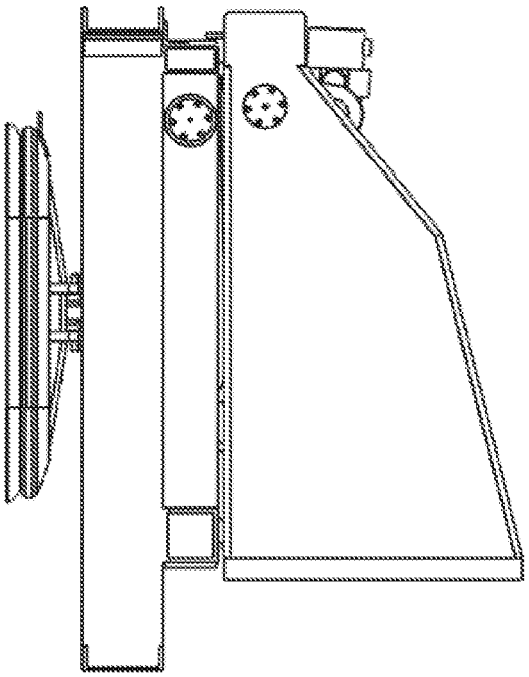
Figure 12A:
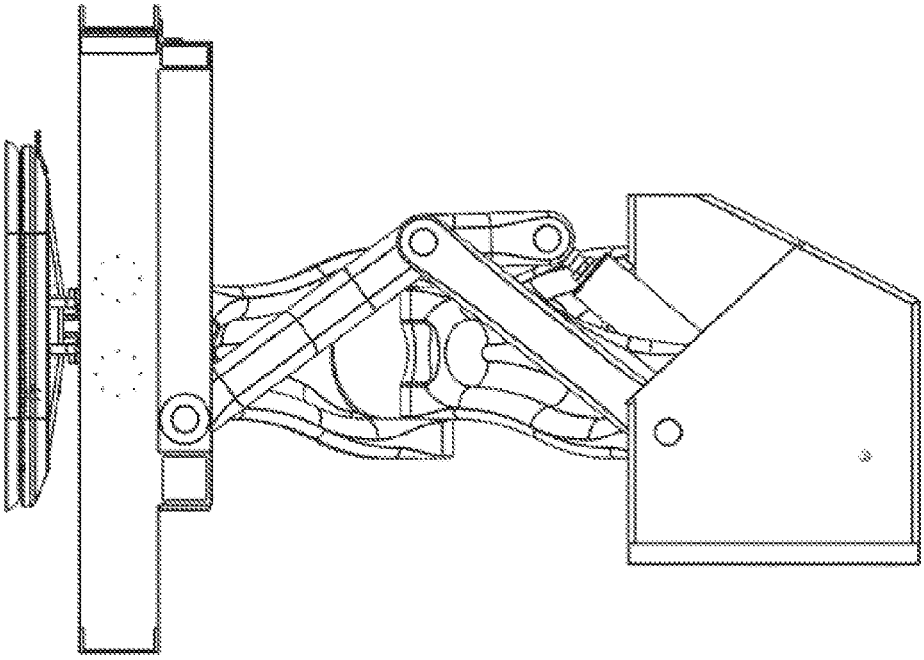
FIG. 12*a/b*: shows a front top perspective view of a mooring robot with an orthogonal extension mechanism, in the n type orientation, in the extended and protracted position respectively, configured for a tricep drive moving arrangement.
Figure 12B:
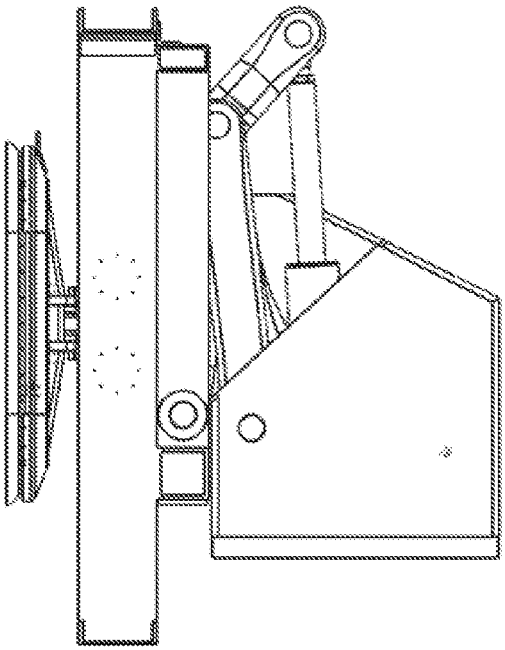

One configuration of extension mechanism 8 is an orthogonal configuration as shown in FIGS. 11 and 12. In the orthogonal configuration, the rotational joint axes of a first linkage 100 are orthogonal to the rotational joint axes of a second linkage 200. I.e. the first linkage 100 is at right angles to the second linkage 200. Furthermore, at least one of the linkage's 9 joint rotational axes are substantially vertical and/or, at least one of the linkage's joint rotational axes are substantially horizontal.

Another configuration of extension mechanism 8 is a diagonal configuration as shown in FIG. 3 at least. In the diagonal configuration. It can be seen that the joint rotational axes are at an angle A to each other. The angle A may be 90° or it may be less than 180°, such as 175 degrees. Furthermore, the joint rotational axes of one of the linkages 9 are not vertical or horizontal. Furthermore the angle between the rotational axes from the horizontal is equal for both linkages. I.e. the linkages 9 are generally orientated symmetrically to each other, i.e they are a mirror of each other about a mid-plane orthogonal to the sway direction Y. Where angles between linkages 9 are described, it is generally referred that comparison is made between like joints, e.g. the angle may between an intermediate rotational axis 141 of a first linkage 100 and an intermediate rotational axis 241 of a second linkage 200.

Figure 10A:
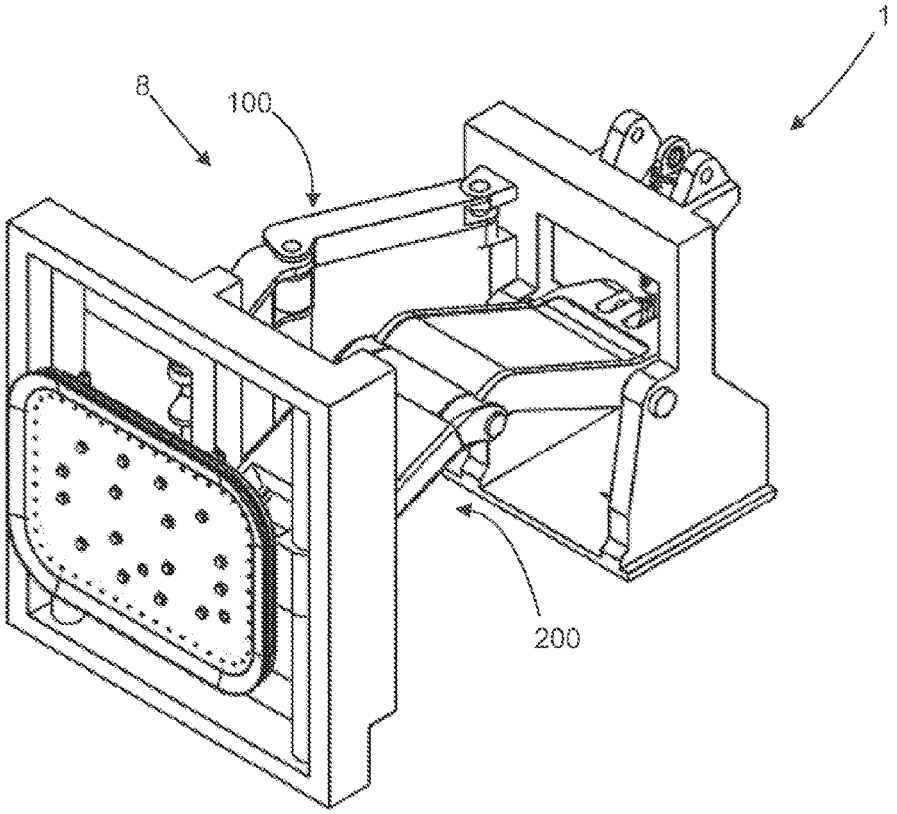
FIG. 10*a/b* shows a front top perspective view of a mooring robot with an orthogonal extension mechanism, in the n type orientation, in the extended and protracted position respectively, configured for a direct drive moving arrangement.
Figure 10B:
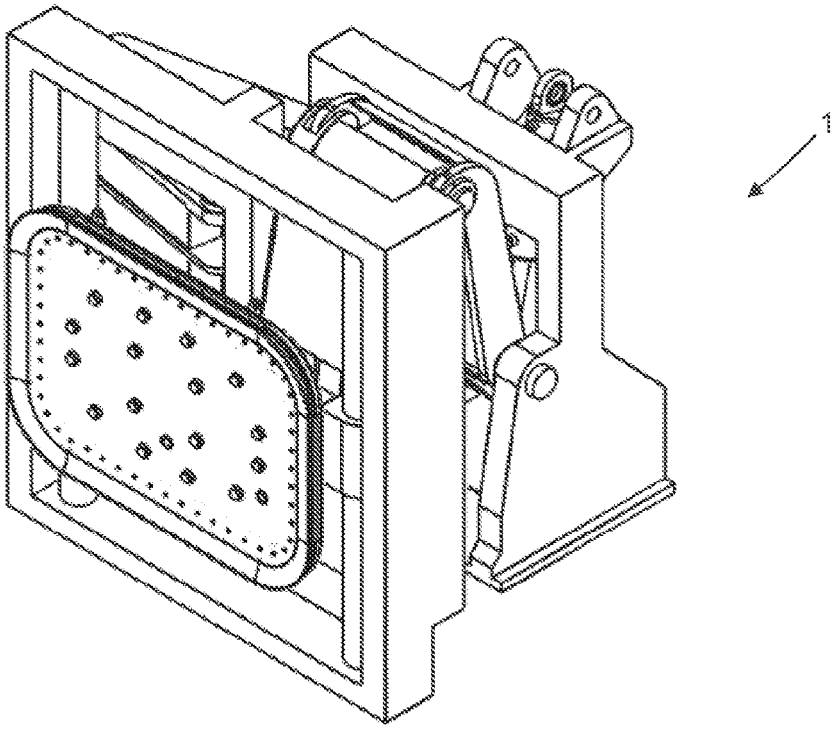

Other possible orientations of the linkages 9 is an 'n' type orientation and a 'v' type orientation. Simply put, whether the linkage 9 bends up or bends down when retracting. For example, FIG. 1 shows two v type linkages, as each linkage makes a notional V, pointing downwards. When retracting, the intermediate joint will move upwards relative the base joint and arm joint. FIGS. 11 and 12, shows a single second linkage 200 in the V type orientation. Alternatively, a linkage may make a notional n pointing upwards, as shown in FIG. 10, where linkage 200 bends upwards. In the n type orientation, when retracting, the intermediate joint will move downwards relative the base joint and arm joint. Changing between the n type orientation and the v type orientation will affect the bias of the extending mechanism to extend or retract under gravity. I.e. Where the intermediate joint wants to move down due to gravity will be the favoured direction to move. I.e. an n type configuration, the extending mechanism wants to extend with gravity, and in v type orientation the extending mechanism wants to retract with gravity.

If the linkages 9 are arranged in a diagonal orientation, they may be further be arranged as W type configuration or M type configuration.

Figure 16A:
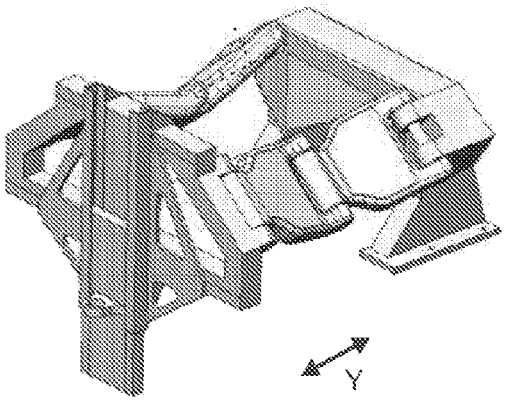
FIG. 16*a/b*: shows a front and rear view of a mooring robot in the extended position respectively, where the extension mechanism is a W type configuration.
Figure 16B:
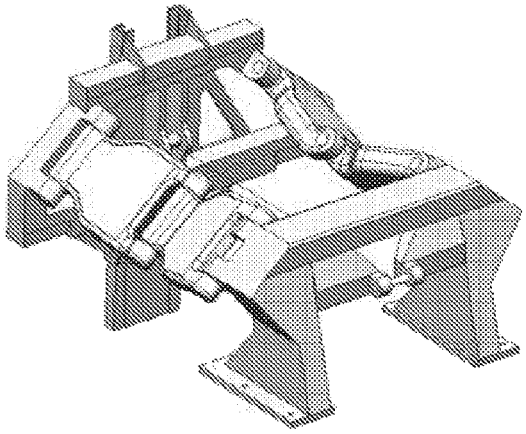

In a W type orientation the intermediate rotational axes 141,241 of two adjacent intermediate joints 140, 240 (or base joints, or attachment joints) extend upwards and towards each other. For example in FIGS. 3 and 16, the notional shape of the converging and intersecting intermediate rotational axes 141, 241 intersect each other and points upwards. Like the shape of the inside portion of a 'W'. The W configuration has the benefits of easier access to the joint pins.

Figure 15A:
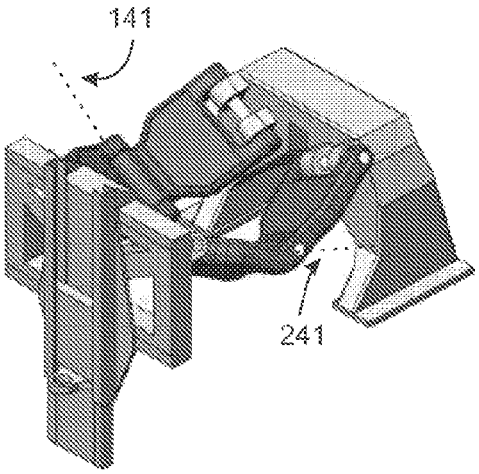
Figure 15B:
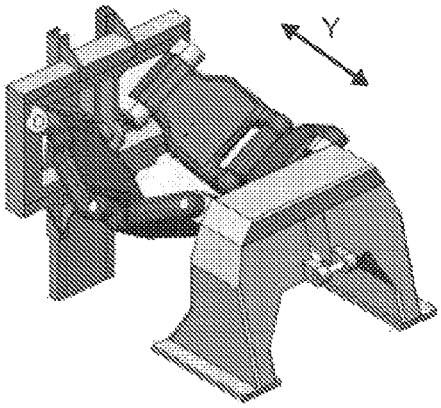

In FIG. 15 the intermediate rotational axes 141, 241 of two adjacent intermediate joints 140, 240 (or base joints, or attachment joints) extend downwards and towards each other. Like the shape of the inside portion of an 'M'. The M configuration has some benefits, such as better access a direct drive centrally located moving arrangement 400 and closer grouping of the intermediate joints.

In the diagonal orientation, preferably the angle A between the two intermediate rotational axes 141, 241 is greater than 0 and less than 180 degrees. Preferably the angle A between the two intermediate rotational axes 141, 241 is between 40 and 150 degrees. Preferably the angle A between the two intermediate rotational axes 141, 241 is between 90 and 130 degrees. Preferably the angle A between the two intermediate rotational axes 141, 241 is 100 degrees, an angle of 100° has been found good for an M type configuration as it has a generally low-stress value compared to other angles of this configuration. Preferably the angle A between the two intermediate rotational axes 141, 241 is 120 degrees, an angle of 120° has been found good for a W type configuration as it has a generally low-stress value compared to other angles of this configuration.

Depending on operational loading, the angle A between the linkages can be adjusted (during manufacture) to provide the most effective angle A for the operational loads. For example, with a diagonal orientation extension mechanism, if there are going to be high surge loads in the X directions, then the angle A can be increased which will be more effective for resistance to these X direction surge loads. If there are high loads in a Z direction, then a smaller angle A is used. Analysis and computer modelling of the stresses in the arms is used to determine optimum angles for specifically shaped arms, specifically shaped linkages, orientation of linkages, and common operation loads.

In summary, the table below shows some of the possible two linkage extension mechanisms configurations. These configurations and orientations can also be applied to extension mechanisms with more than two linkages.

TABLE 1

| Possible extension mechanisms arrangements | | | | | | | | | | | | |
|---|---|---|---|---|---|---|---|---|---|---|---|---|
| | Orthogonal orientation | | | | Diagonal orientation | | | | | | | |
| Drive Type | Direct drive | | Tricep drive | | Direct drive | | | | Tricep drive | | | |
| Orientation | n type | v type | n type | v type | n type | | v type | | n type | | v type | |
| Configuration | — | — | — | — | W Type | N Type | W Type | N Type | W Type | N Type | W Type | N Type |

The three joints (joints including, base joint 130, intermediate joint 140 and attachment joint 150) are preferably single-axis rotational joints, i.e they act as a revolute joint. The joints can be arranged in many arrangements as long as they have a single rotational axis. The joints are preferably a pin and hole joint. For example, the base joint 230 on the second linkage has a pin 232 and hole 233 as shown in FIG. 3, the hole 133 of the first linkage 100 can be seen easier in FIG. 3. Other types of joints may be used. For example, an extended cylindrical socket formed in the distal end of the attachment arm and a complementary cylindrical formation to slide within the socket formed in the distal end of the base arm (not shown). The joints may be formed from multiple multi-rotational axis joints, that together form a single axis rotational joint. For example, a joint may be formed of two multi-axis rotational ball and socket joints that are attached to the end of one arm, that due to the limited degree of freedom can only rotate in a single axis.

Preferably the rotational axes 131, 141, 151 of the joints of one linkage are all parallel with each other. Preferably, this is true for each linkage of the extension mechanism. This allows the linkages 9 to act as part of the sarrus mechanism that is formed by the attachment element 300, extension mechanism 8, and base 500.

Figure 9:
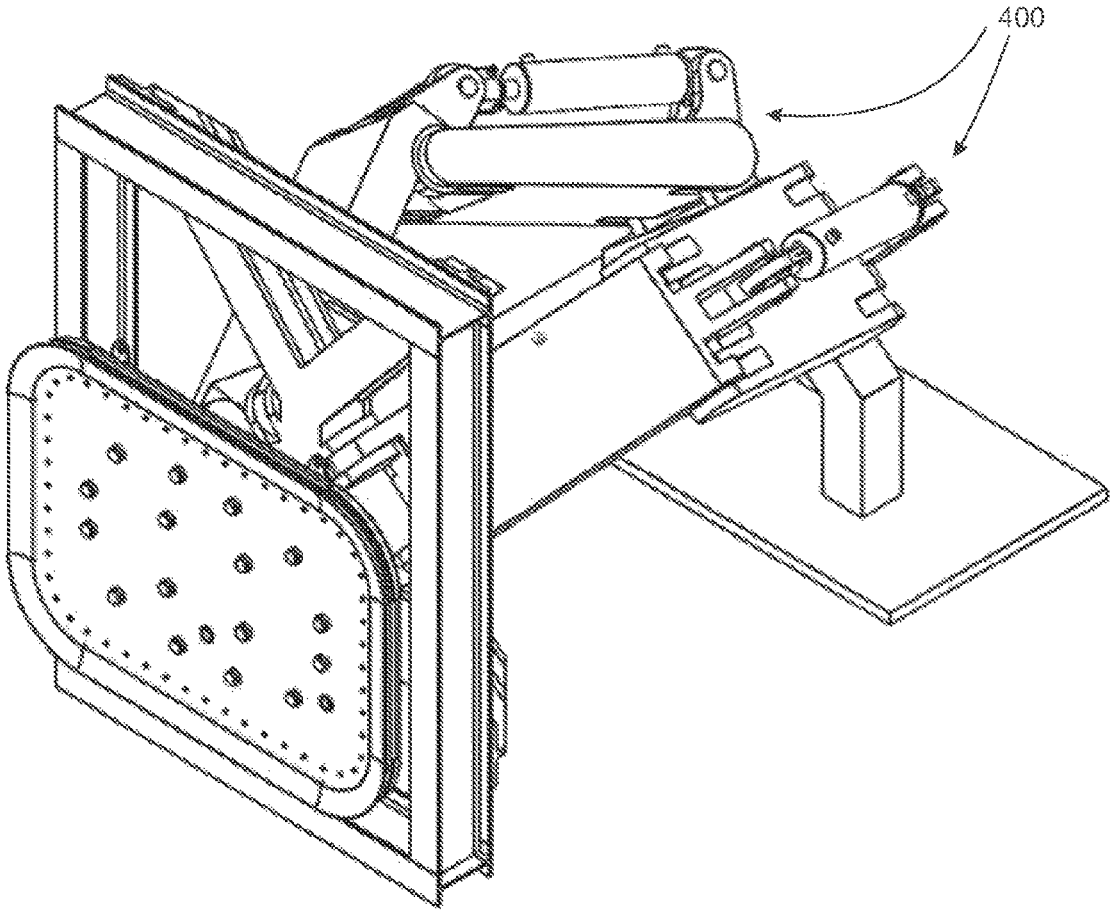
FIG. 9: shows the mooring robot of FIG. 3 with a tricep drive configuration.

Preferably the intermediate joint has a maximum rotational angle of 180 degrees, this would be in an embodiment where the arms are able to nest, or both have an extension at their distal ends, such as the arms shown in FIG. 9. Where arms are straight and the joint axes are located at the ends of the arms the rotational angle maybe less than 180 degrees.

Preferably the linkages 9 cannot over-extend or go over-centre. An example of fully extended is when both the base rotational axis and attachment rotational axis are at a maximum distance apart from each other. Over extending is when the arms continue to rotate past the fully extended position. An example of over extending is when the intermediate axis continues to move in the same direction as when it was when extending, after both the base rotational axis and attachment rotational axes already gone to a maximum distance from each other. A fully extended distance will be combined length of the arms, where the length is between the rotational axes as shown in FIGS. 17 A and B. A minimum retraction distance will be the thickness t of the arms, as shown in FIGS. 17 C and D.

When the base arm 110 and attachment arm 120 extend to a fully extended position, preferably they cannot continue pivoting with respect to one another in the same direction. Each linkage may have a limitation on each intermediate joint to effect this. Alternatively, or in combination, the base arm 110 or attachment arm 120 comprises a stop that prevents the respective arms from going past 180° with one another. Alternatively, or in combination, the moving arrangement 400 may comprise a limitation where the moving arrangement 400 cannot or does not extend past a certain distance, thus preventing the arms getting to or going past 180° with each other. I.e., a hydraulic actuator may have a stroke that is less than that required to extend the arms fully.

In combination with the above, the extension mechanism 8 may be so configured that the weight of the linkages 9 in combination with the attachment element 300 prevents the arms over-extending. In the v type, the weight of the arms works to keep the arms from over extending, and if a hydraulic actuator fails or the actuation force goes to zero, the extension mechanism will self-retract due to gravity.

In one embodiment, the rotational axes 131,141 of the joints are all on vertical planes. Preferably like/common joints, such as the base joint 130 and base joint 230 et cetera have a respective rotational axis on the same plane. Likewise, this is true for the intermediate joints 140,240 and attachment joints 150,250. Preferably each like (common) joint between adjacent linkages has rotational axes on the same vertical plane (where the extension mechanism is used to extend in the horizontal transverse direction). Due to being on the same plane and at an angle, the like/common rotational axes will intersect at a point.

In other embodiments, one such embodiment shown in FIGS. 26 to 29, the rotational axis 131 of one base arm, is not on the same vertical plane as the rotational axis 231 of a second base arm. As such the base joint 130 and base joint 230 and/or attachment joints 150,250 have a respective rotational axis offset from each other. This is most easily seen in the plan view of FIG. 29 which shows an extension mechanism 8 extended, with two linkages at 90 degrees to each other and having offset base joint and attachment joints. Out of plane pivot points allow for the arms to overlap leading to a more compact design.

Figure 18A:
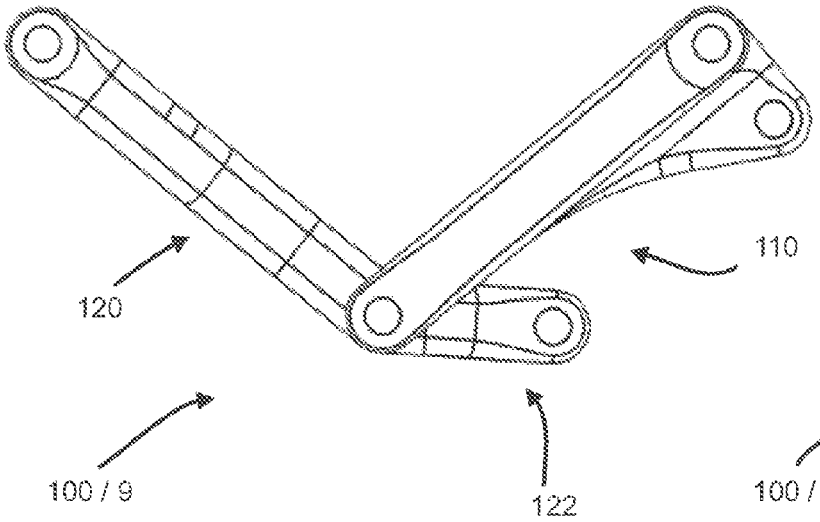
FIG. 18*a/b*: shows a side view of a linkage in isolation, with different length arms in an extended and retracted position respectively
Figure 18B:
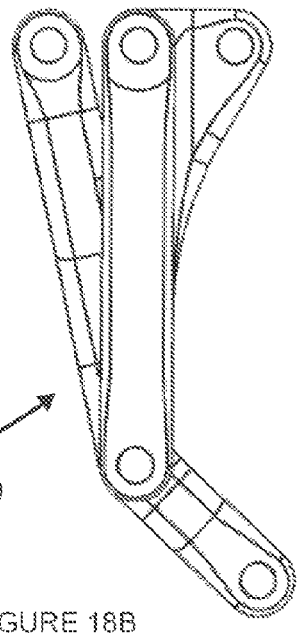

The arms of a linkage 9 are typically the same length as each other, i.e the distance between the base pivoting axis 131 and intermediate pivoting axis 141 is equal to the distance between the intermediate pivoting axis 141 and the attachment pivoting axis 141. The respective arms between linkages however, i.e. a base arm 110 and a base 210 are always the same length (L, as shown in FIG. 17). The arms in isolation are shown in FIGS. 17 A-D, where FIGS. 7 A and 7 C show a plan view and side view of an attachment arm 120, and FIGS. 17 B and 17 C show a plan view and side view of a base arm 110. In some embodiments the arms of a linkage 9 are not the same length as each other, an example of an attachment arm 120, being longer than the base arm 110 is shown in FIG. 18 A and FIG. 18 B. FIG. 18 B shows the different length arms in the retracted position, where the base arm 110 is substantially vertical, and the attachment arm 120 is off-vertical, yet the attachment joint and base joint are substantially horizontal with each other. Having different length arms may be used where specific space constraints or access constraints are required, or further nesting of the arms and drive mechanisms are required.

In other embodiments the arms of one linkage have different lengths, so that (for example if the linkage had its base joint horizontal) the attachment joint would be above or below the base joint. For the extension mechanism to operate, then other arm (assuming a two linkage sarrus, and the other arm is at 90 degrees to the first arm) is kinked so that the respective base joint is above or below the attachment joint respectively. In other words, a linkage's attachment joint's rotational axis is offset in the direction along the rotational axis the base joint's rotational axis. Off-set pivot points allow for the arms (of either or both linkages) to overlap leading to a more compact design.

Figure 30:
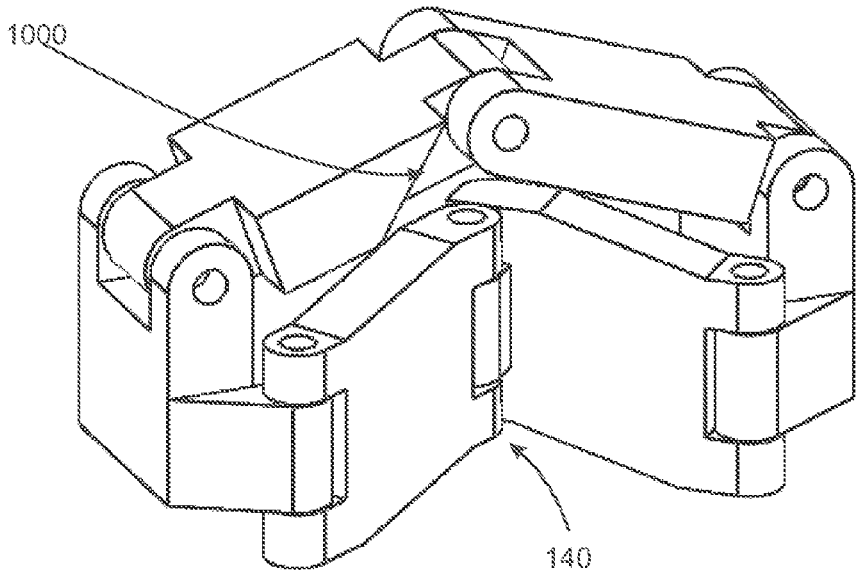
FIG. 30: shows a perspective of an embodiment of a mechanism where the arms the intermediate joint is offset the base and attachment joint.
Figure 31:
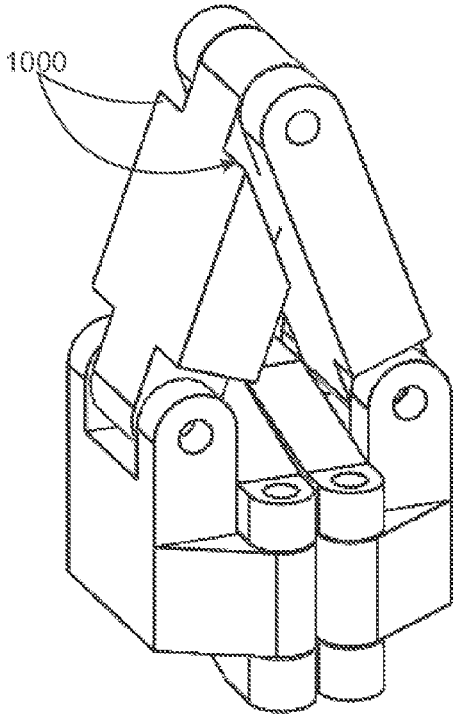
FIG. 31: shows a view of FIG. 30 in the collapsed condition.

In further embodiments, one as shown in FIGS. 30 and 31, the intermediate joint 140 is offset in a direction of the rotational axis compared to the attachment joint and base joint. Both arms are required to be kinked, skewed or angled to allow the intermediate joint 140 to be offset. Offset pivot points allow for the arms (of either or both linkages) to overlap leading to a more compact design. The arms may have cut outs, or recesses 1000 to allow adjacent linkages to better nest and lead to a more compact retracted design.

The above variations and embodiments are considered to be within the scope of the invention and applicable to many of the other designs and configurations described herein.

In one embodiment, one or both of the attachment arm 120 and the base arm 110 have an L shaped feature 123. This L shaped feature 123 is shown in the least FIG. 5A and FIGS. 17C and 17D, where at least attachment arm 120 has a curved feature going towards the intermediate axis 141. The L-shape 123 is not necessary L shaped, but at least has a general curve or offset from the elongate length of the arm. The L shape 123 allows the attachment arm 120 to fold back upon and nest closer to the base arm 110. This allows a more compact folding of the linkage 100. In one embodiment, the attachment arm 120 comprises an abutting surface 124 that is configured to abut against the base arm 110. The abutting surface 124 can abut flush against a like surface on the base arm 110. The abutting surface 124 may act as a stop so that any undue force onto the attachment element 300 is driven through the abutting surface 124 and not the intermediate joint 140. The L shape 123 can be located on either the attachment arm 120 or the base arm 110 or both. Due to the L-shape 123, when the arms extend towards 180° to each other, there will not be perfectly straight due to the slight kink of the L-shape. A skilled person in the art will realise there are many ways to achieve a compact folding of the arms to each other without an L shape 123, by instead utilising a joint that allows a similar configuration. I.e. where the intermediate joint pin 142 is located directly in-between both the attachment arm 120 and base arm 110, like a door hinge. An example of symmetrical arms each with a like L-shape 123 is shown in FIGS. 17C and 17D, where the intermediate joint 140 (when the arms are engaged to each other) would be in the middle of the two arms.

Figure 2:
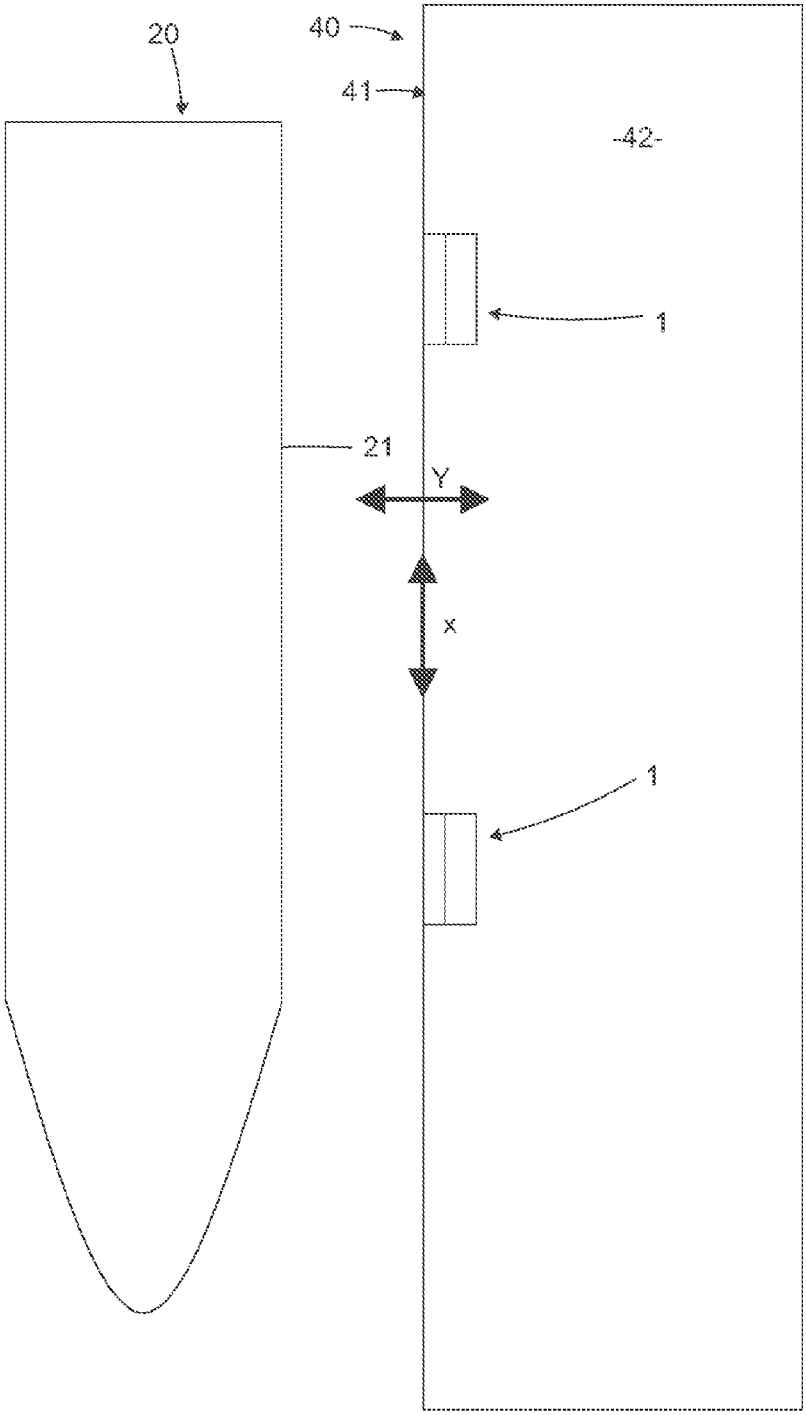
FIG. 2: shows a schematic plan view of a vessel, dock and associated mooring robots.

The attachment element 300 is supported and dependent from the linkages 9. The attachment element 300 may comprise a number of sub-elements such as an engagement element 310. The engagement element 310 is configured to engage with a vessel 2. The engagement element 310 is configured to engage with a surface or other feature of a vessel 2. Preferably the engagement element 310 is one or more selected from a vacuum pad, vacuum cup or cups, hook device, resilient fender, magnetic connection, fluid transfer connection, a charging connection, or other engagement feature configured to releasably engage with a vessel 2. A vacuum pad 311 is shown in FIG. 1. The vacuum pad 311 may be configured to engage with a surface 21 of a vessel 2 as shown in FIG. 2. Vacuum pads or engagement elements are generally well known in the art.

The attachment element 300 may further comprise a sliding mechanism 320. The sliding mechanism 320 allows the engagement element 310 to move in multiple directions to allow for the vessel move relative the dock, without having to disengage the engagement element 310. Preferably, the sliding mechanism 320 allows the engagement element 310 to move in both the surge X and heave Z direction as shown in FIG. 2. The sliding mechanism 320 is generally known in the art also. Where there is a sliding mechanism 320, the linkages 9 attach to the sliding mechanism 320.

In one embodiment, the attachment element 300 is for engaging a vessel 2. Such engagement may not be for fastening a vessel 2, but instead may be used to engage with a vessel 2 to transfer power or fluid. In some embodiments, the attachment element 300 can both fasten a vessel 2 and engage a connection to a vessel 2. There are a number of ways that the attachment element 300 can be extended and retracted from the base 500 when being supported by the extension mechanism 8.

The attachment element 300 may further comprise a frame 330. The frame 330 is configured to connect to the linkages 9 instead of the linkages 9 connecting directly to the sliding mechanism 320. The frame 330 allows the linkages 9 to be easily attached to the attachment element 300. Intermediate the frame 330 and the engagement element 310 is the sliding mechanism 320.

Preferably the sliding mechanism 320 comprises at least one selected from a substantially vertical elongate guide 321 configured to allow the engagement element 310 to raise and lower (i.e. in the up and down or heave direction Z) with respect to the base; and a substantially horizontal elongate guide 322 configured to allow the engagement element 310 to move fore and aft (i.e. in the back-and-forth/surge direction X) with respect to the base 500.

Figure 14:
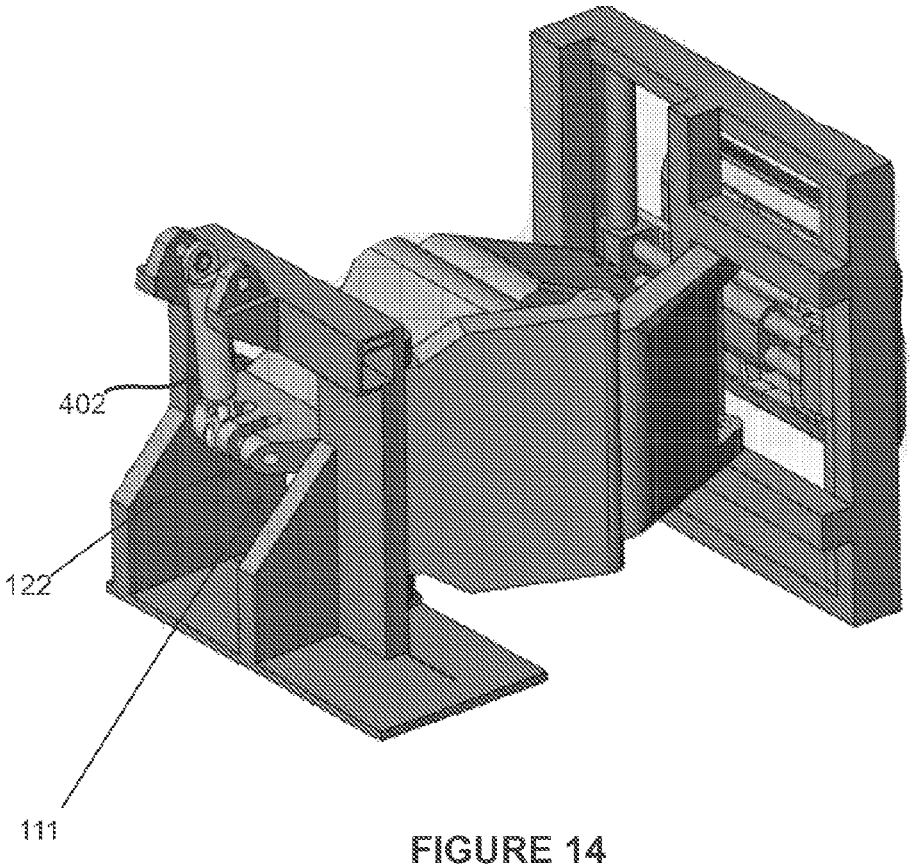
FIG. 14: shows a rear top perspective view of a mooring robot with an orthogonal type extension mechanism utilising a single tricep drive on the base arm, where one linkage is an n type linkage FIG. 15*a/b*: shows a front and rear view of a mooring robot in the extended position respectively, where the extension mechanism is a M type configuration.

In some embodiments, the sliding mechanism 320 allows passive movement of the engagement element 310. Whereas in other embodiments the sliding mechanism 320 allows powered movement of the engagement element 310, as shown in FIG. 14. Preferably the moving arrangement 400 is engaged between the base 500 and the frame 330.

In further embodiments, the sliding mechanism 320 comprises resilient means such as rubber dampers, springs, or fenders that allow the engagement element 310 to one or both of; translate; and rotate in one or more axes. This may be in combination with vertical and horizontal sliding movement.

In some embodiments, there may be a passive moving arrangement (not shown) that can absorb any impact, or resist forces, onto the attachment element 300 acting in the transverse direction. I.e. the mooring robot can act as a damper. However, in other embodiments, the moving arrangement is an active moving arrangement 400.

In one embodiment, the active moving arrangement 400 is a powered actuating arrangement 401. Wherein the powered actuating arrangement 401 comprises one or more selected from a hydraulic actuator 402, an electric actuator, a chain drive system, and belt drive system.

The moving arrangement 400 may extend either between the base 500 and the attachment element 300—known as a direct-drive configuration. Examples of a direct drive configuration are shown in FIGS. 1, 3, 4-8.

Alternatively, or in combination with the direct-drive configuration, the moving arrangement 400 also extends between the attachment arm 120 and the base 500. In this arrangement, the moving arrangement is known as a tricep-drive configuration. Wherein the moving arrangement extends from an extension 122 off either the attachment arm 120 or base arm 110, and the other end of the moving arrangement is fixed pivotably relative to the base 500, an example of this is shown in FIGS. 11, 12, 14.

In one embodiment, the extension 122 extends off the distal end 121 (towards the intermediate joint 140) of the attachment arm 120 to act as a lever for the moving arrangement 400 to pivotably connect to, as shown in FIGS. 11 and 12.

In one embodiment, the extension 122 extends off the proximal end 111 of a base arm 110 as shown in FIG. 14. This allows a moving arrangement 400 to extend between the base 500 and the extension 122, located on the base arm 110.

The tricep-drive configuration may have higher deflections and pin loads compared to the direct-drive configuration.

The extension 222, and associated moving arrangement 400 may be present on one or more linkages 9. A tricep drive configuration present on only one linkage is shown in FIG. 14.

Moving Arrangement 400

The configuration of the moving arrangement 400 depends on the type of configuration and drive of the linkages 9. For example, a W orientation extension mechanism 8 does not lend to the use of a tricep drive configuration because of the lack of space for the tricep drive configuration moving arrangement 400. Generally, in the diagonal embodiments, a direct drive configuration is utilised. However FIG. 9 shows an example of a diagonal embodiment with a tricep drive.

Figure 6A:
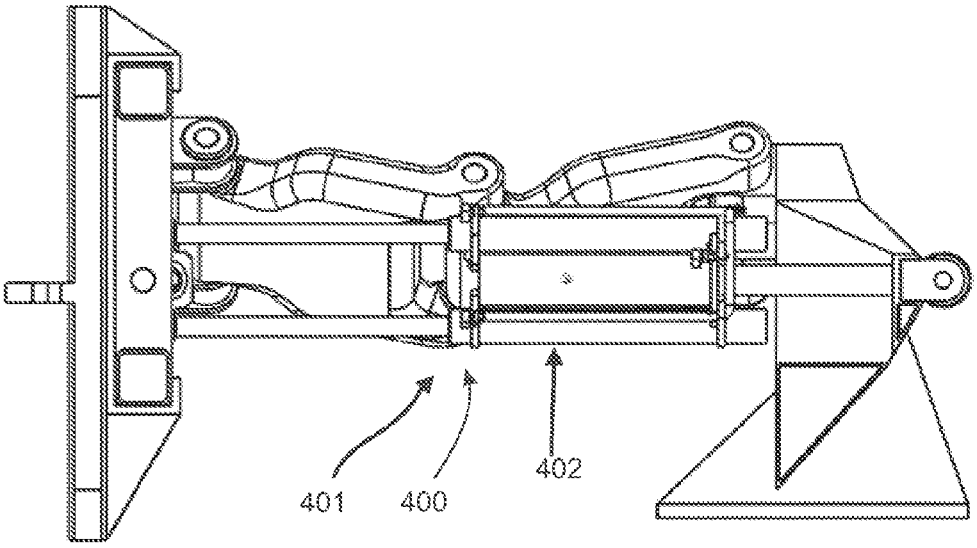
FIG. 6*a/b*: shows cross section side views through the midplane of FIG. 4A/4B.
Figure 6B:
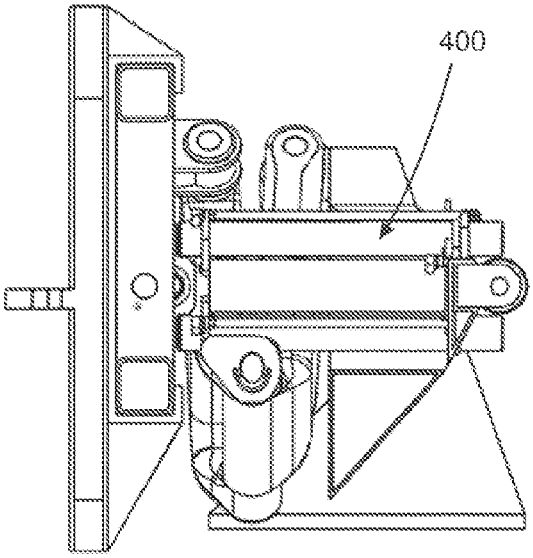
Figure 7A:
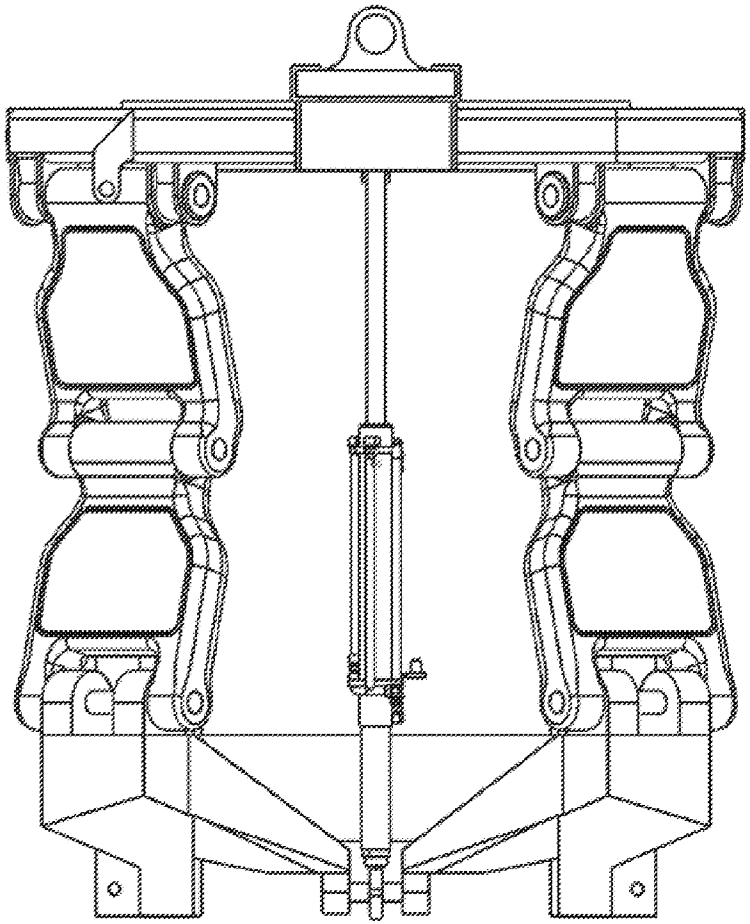
FIG. 7*a/b*: shows top views of FIG. 4*a*/4*b*
Figure 7B:
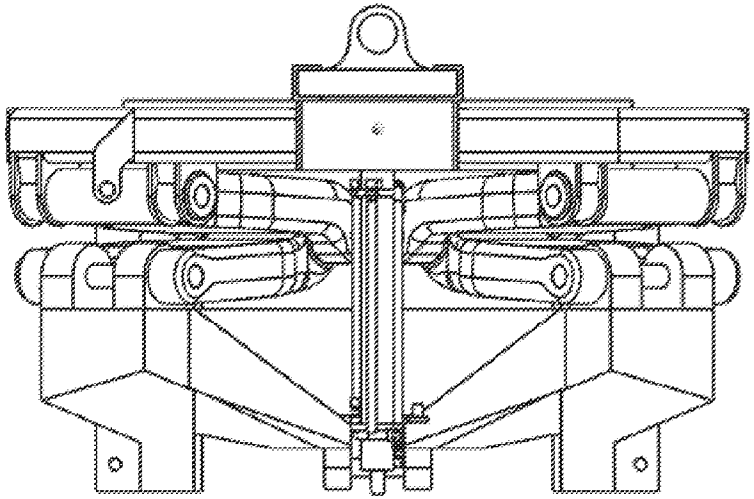
Figure 8A:
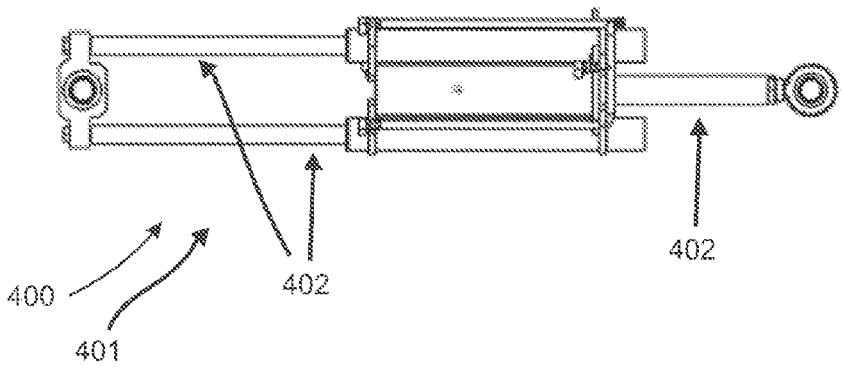
FIG. 8*a/b*: shows a compound hydraulic actuator in an extended and retracted position.
Figure 8B:
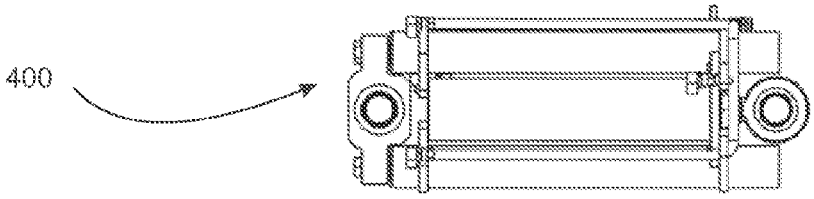

In one embodiment, the moving arrangement 400 is one or more hydraulic actuators 402 and associated features such as pivoting joints etc. The hydraulic actuator or actuators 402 in one embodiment is a single hydraulic actuator 402 on one or more linkages in the tricep drive configuration. The hydraulic actuator 402 extends between the extension 122 and the base 500. In the direct-drive configuration, the hydraulic actuator 402 extends between the base 500 and the attachment element 300. In the preferred embodiment, the direct-drive configuration is a compound hydraulic actuator 402 as shown in FIGS. 7 and 8. The compound hydraulic actuator 402 allows a greater range of travel. FIG. 8*a* shows the compound hydraulic actuator 402 in an extended position, and FIG. 8*b* shows the compound hydraulic actuator 402 and a retracted position. FIGS. 6*a* and 6*b* show a cross-sectional view through the midplane of a mooring robot 1, to highlight the moving arrangement 400 and the extended and retracted position respectively.

Preferably the moving arrangement 400 as described above does not support any weight of the attachment element 300 in the vertical direction Z. Preferably the moving arrangement 400 is pivotably connected to the features that support it. However, in other embodiments, the moving arrangement 400 can support some weight of either the linkages 9 or moving arrangement 400, for one example—in a rotary drive embodiment. The weight that the moving arrangement 400 supports is minimal compared to the overall weight of the attachment element 300 and linkages 9.

In a further embodiment, the moving arrangement 400 may be comprised of or comprise rotary drivers (not shown) as a powered actuating arrangement 401. The rotary drivers may be electric or hydraulic motors located at one or more joints of one or more linkages 9. In one embodiment, a rotary driver comprises a hydraulic cylinder configured to turn a rotary spline that actuates a joint.

In one embodiment, the rotary driver is a hydraulic motor located at the intermediate joint 140 to drive relative motion between a base arm 110 and an attachment arm 120. In some embodiments, there is a rotary driver located at all three joints of one linkage. In other embodiments for example, there is a rotary driver on two linkages 9, at the base joints 130, 230. There are many configurations the movement arrangement may take.

In a further embodiment, the moving arrangement 400 may comprise one or more of the above powered actuating arrangement. For example, one or more selected from a tricep drive, direct drive, and rotary driver. For example, in one embodiment, the mooring robot 1 comprises a tricep drive and a rotary driver. When in the fully retracted configuration, there may be a very large force required due to minimal leverage to actuate the tricep drive to extend the linkage or extension mechanism. In this case the rotary driver will be actuated to start off the extension of the extension mechanism 8, and once a greater leverage is able to be utilised, the tricep drive will aid or take over extension of the extension mechanism 8.

Base

The base of 500 is generally arranged to support the linkages 9 and in turn the attachment element 300. The base 500 comprises a foot 511 that is configured to be mounted to a dock or second vessel 2. The mounting may be via bolted connection, or like permanent connection or another mechanical type fit.

Figure 19:
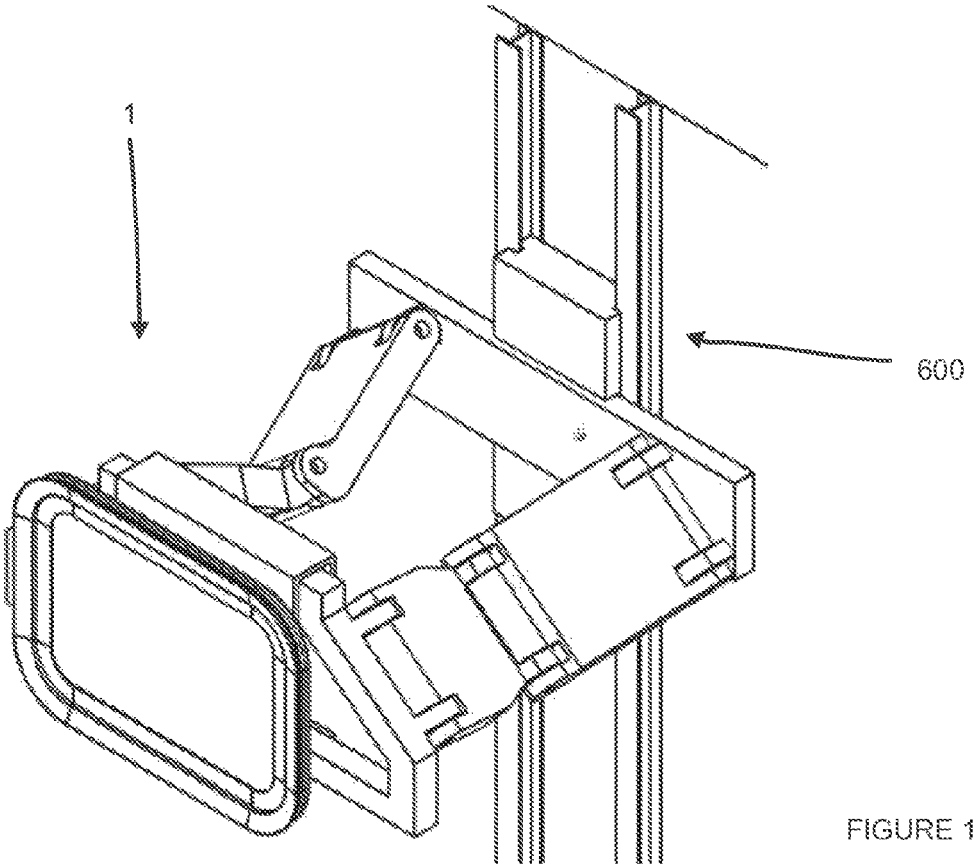
FIG. 19: shows a front top perspective view of a mooring robot engaged with vertical rails.
Figure 20:
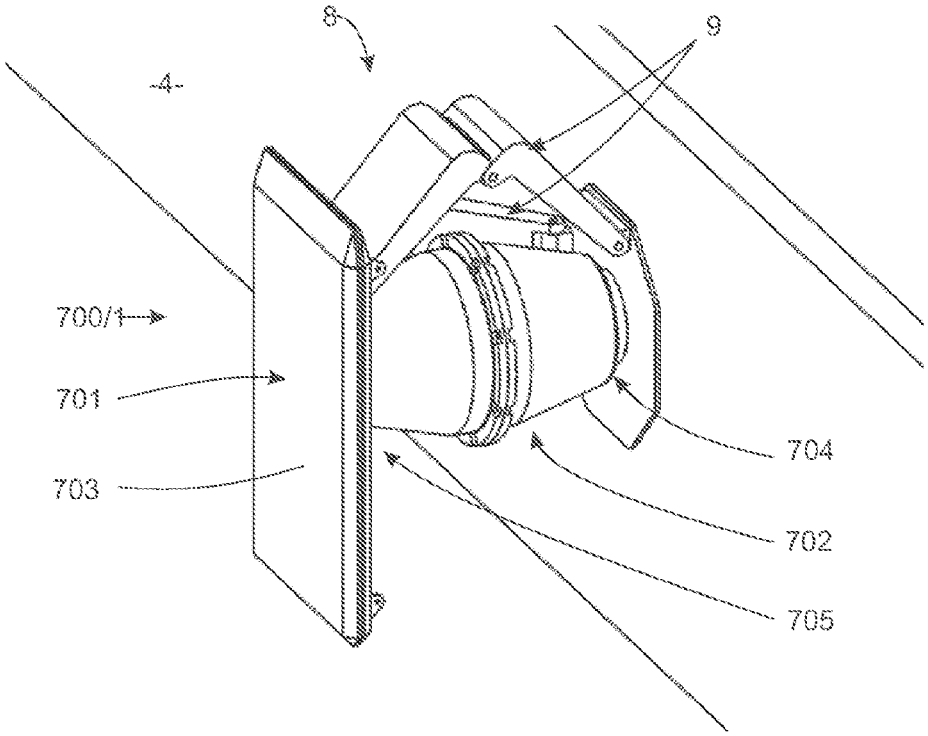
FIG. 20: shows a front top perspective view of a fender and fender mechanism on a side of a dock, where the mechanism has two linkages; one at the top and one at the side.
Figure 21:
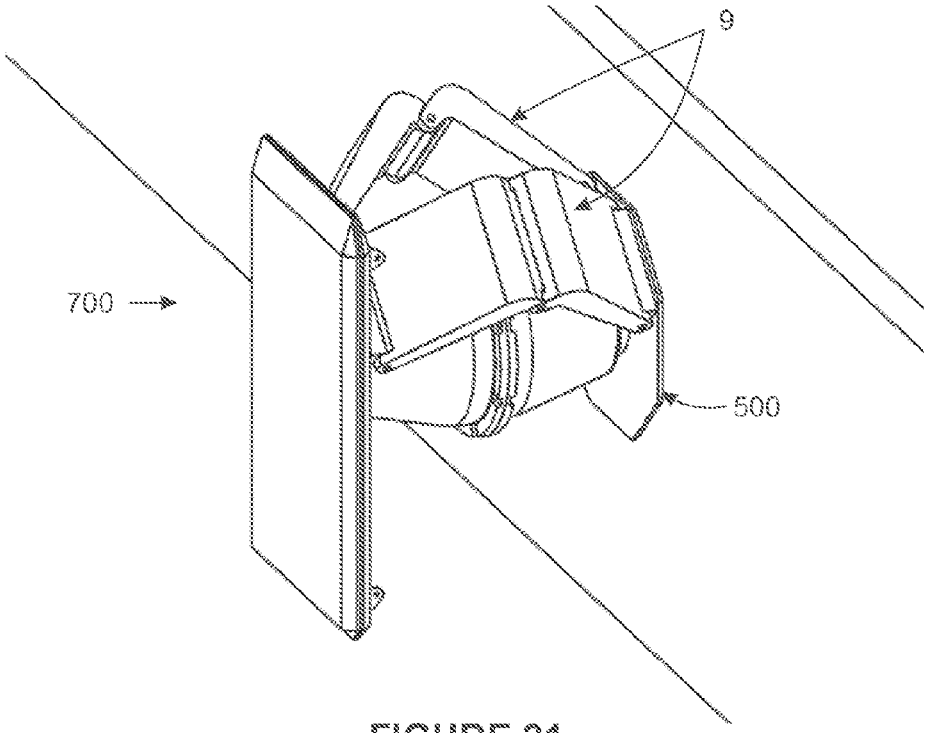
FIG. 21: shows an alternative of FIG. 20, where the two linkages are located 45 degrees either side of the top.
Figure 22:
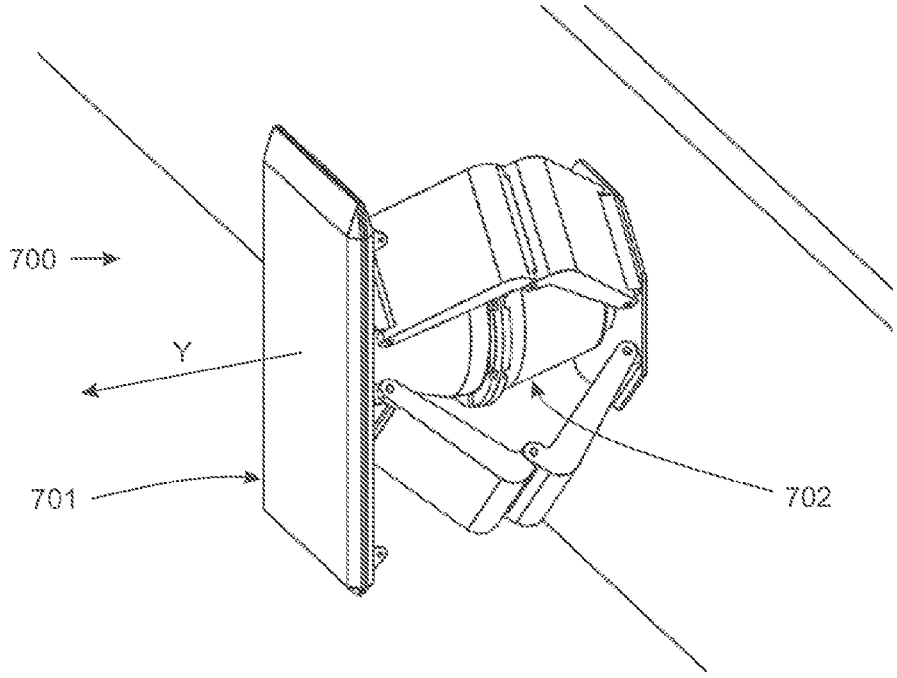
FIG. 22: shows an alternative of FIG. 20, where the two linkages are located 45 degrees either side of the side.
Figure 23:
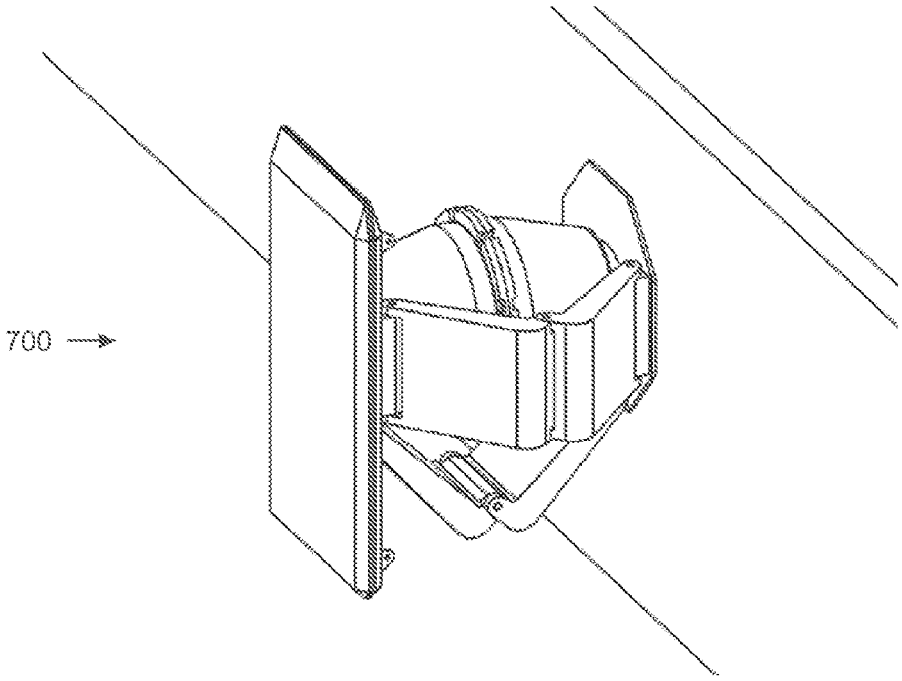
FIG. 23: shows an alternative of FIG. 20, where the two linkages are located the side and bottom.
Figure 24:
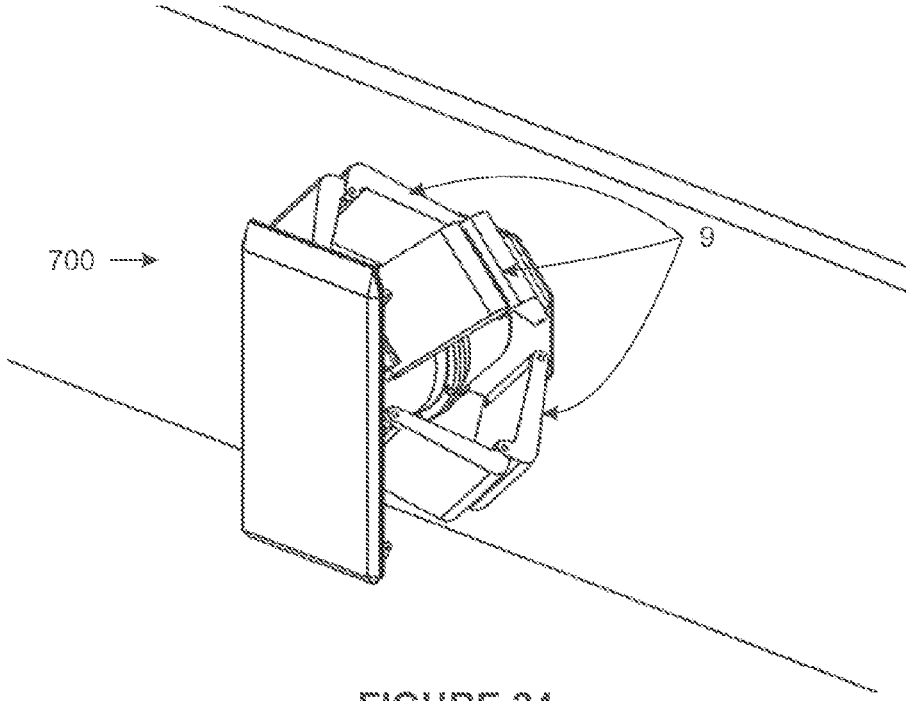
FIG. 24: shows a front top perspective view of a fender and fender mechanism on a side of a dock, where the mechanism has two three linkages.
Figure 25:
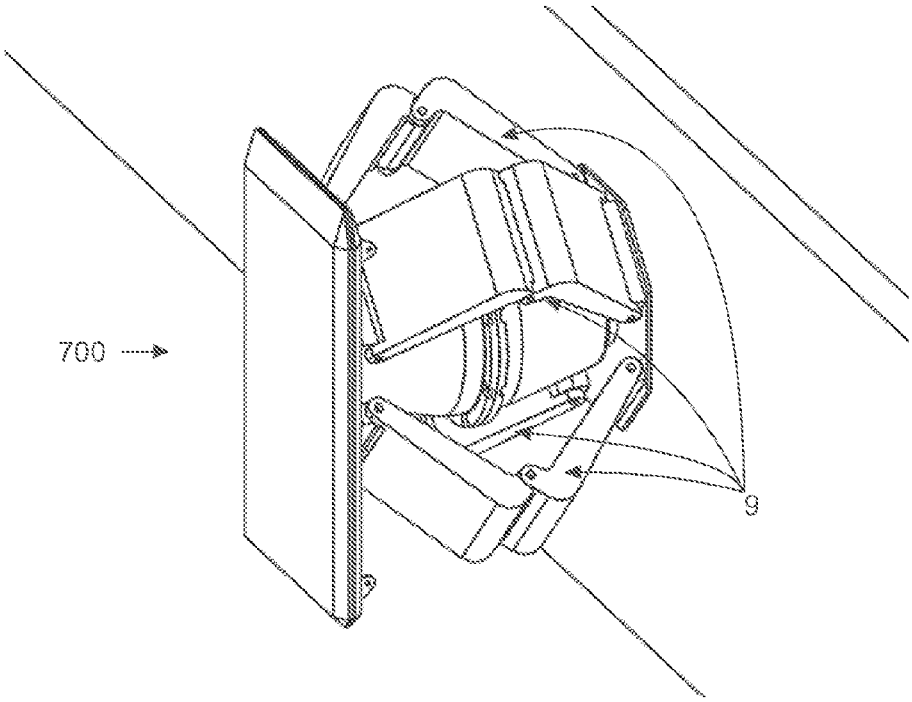
FIG. 25: shows a front top perspective view of a fender and fender mechanism on a side of a dock, where the mechanism has two four linkages.
Figure 26:
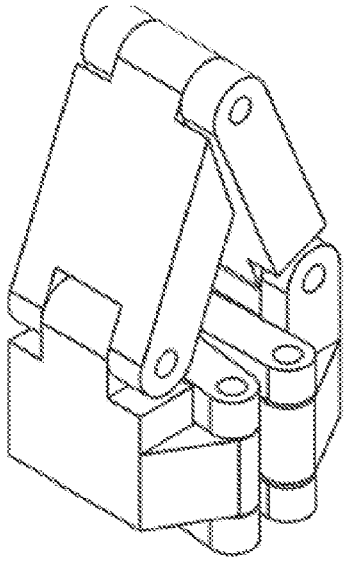
FIG. 26: shows a top front perspective view of a mechanism with off set base and attachment joints, in a collapsed condition.
Figure 27:
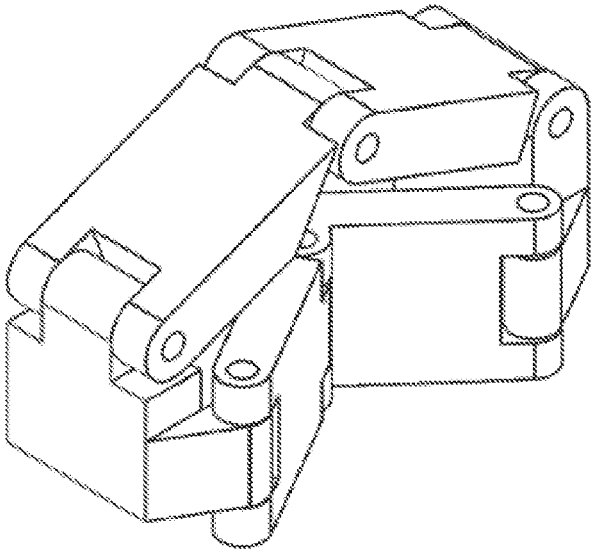
FIG. 27: shows an extended condition of FIG. 26.
Figure 28:
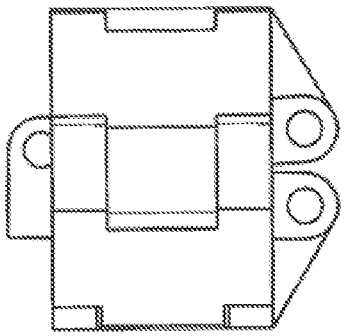
FIG. 28: shows a top view of FIG. 26
Figure 29:
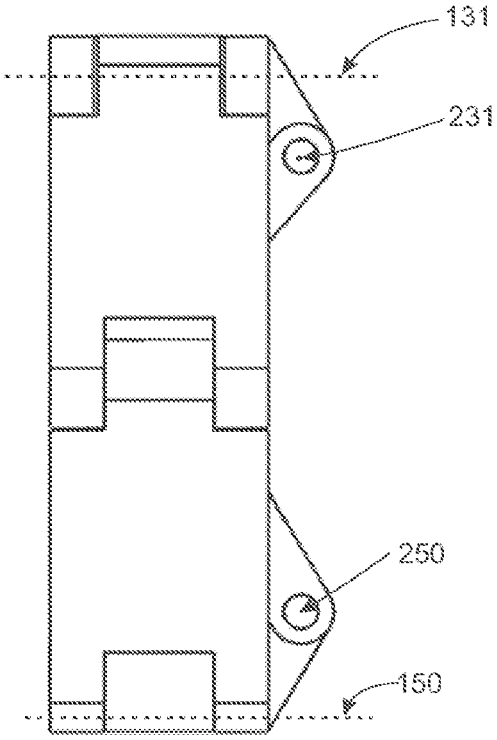
FIG. 29: shows a top view of FIG. 27

In some embodiments, the base 500 is mounted to a movable arrangement 600 on the dock 2, or any other like structure such as an offshore structure. The movable arrangement 600 can allow the base 500 to move relative to the dock 2. For example, the movable arrangement 600 may allow the base 500 to move laterally in the surge direction X along the dock 2. In other arrangements or in combination, the movable arrangement 600 as shown in FIG. 19 may allow the base 500 to move vertically in the heave direction Z. The movable arrangement 600 may be a set of sliders or rails.

The base 500 may be vertically mounted to the side of a dock 2 for example. The base 500 may be engaged onto vertical rails on the side of a dock 2 or offshore structure. With the movable arrangement 600, the moving arrangement 400 located at the attachment element 300 may be modified to incorporate the potential freedom that the movable arrangement 600 allows. For example if the movable arrangement 600 allows some vertical movement, then the moving arrangement 400 may not require as much, or no, vertical movement.

The present invention with the base 500 having a small footprint leads itself to the base 500 being engaged to a rail system 600 as shown in FIG. 19. In embodiments where the base 500 is engaged to a vertical rail system 600, the entire mooring robot 1 may be rotated 90° so that it is not very wide and can fit on a relatively narrow rail system. In such an embodiment, the vacuum pad may be in the same orientation as shown in figures, but the frame 330, the linkages 9 and base 500 have all been rotated 90° in either direction about a horizontal axis extending in the sway direction Y. The angle A between the joints may be adjusted (via orientation of the linkages with respective to each other and the dock) so that appropriate loading stresses through the mooring robot are found.

Fender

In some embodiments the mooring robot 1 acts purely acts purely as a fender 700. In such embodiments the element 300 may not releasable engage with said vessel, but merely make contact with the vessel. In the fender 700 embodiment the element 300 does not comprises an attachment feature, but is merely a large surface, such as a contact surface 703, capable of contacting a surface of a vessel. The fender 700 comprises a fender element 701, and an energy absorbing element 702 and utilising the mechanism 8 as herein described.

Much of the above description of the mooring robot 1 is analogous with a fender of the same invention that utilises a mechanism 8 herein described. The mechanism 8 comprising at least two linkages. Where the rotational axes of the linkages are at angles to each other, or at least not parallel to each other.

The energy absorbing element 702 of the fender 700 is equivalent to the moving arrangement within the mooring robot 1. This analogy allows the previous description of location etc of the moving arrangement to be equivalent to the energy absorbing element 702. The energy absorbing element 702 is preferably located central to the fender 700 and fender element 701.

The fender element or attachment element will follow a straight line path as the fender element or attachment element move in and out in the transverse direction towards and away from the base. This is called a parallel motion fender. As the contact surface 703 of the fender element 701 is able to stay parallel the dock 4, quay, or second vessel. The path of the fender element 701 may be described as following a straight line or straight path. Where the straight path is linear. Preferably the straight path is horizontal in instances where the fender 700 is attached to a dock or quay, likewise for the mooring robot. The straight path may be described as orthogonal to any of the rotational axes of the revolute joints. A straight path of movement of the element prevents or at least reduces any shear or angular distortion being put into the energy absorbing element 702. For example, if the fender element 701 is at an angle to the vessel, the rated reaction of the energy absorbing element 702 needs to be reduced. A straight path may increase life of the energy absorbing element 702.

Prior art fenders may utilise single arms, these single arms may be quite long, and as such the arc that scribed by the fender element at the end of the arm may appear to follow a straight path. These fenders have a large footprint due to the long arms required to achieve a large diameter arc for apparent parallel motion.

The fender 700 or mooring robot 1 does not comprise a system utilising vectored control for maintaining said straight path. The straight path is dictated by the geometry of the mechanism.

The movement of the element/linkage is due to impact (imparting of motion) from a vessel with the fender element 701.

The energy absorbing element 702 comprises a proximal end 704 and distal end 705, wherein the proximal end 704 is restrained to either the dock, second vessel, or base and the distal end 705 is restrained to one or more linkages 100, 200 at or towards the element 701 and/or the element 701.

In one embodiment, the energy absorbing element at least partially supports the weight of the element. However in some embodiments the mechanism fully supports the fender element, and/or as well as fully supporting the distal end 705.

In one embodiment, the mechanism resists shear movement in the energy absorbing element when the element is impacted by a vessel.

In one embodiment, mechanism resists vertical movement of the distal end of the energy absorbing element.

The mechanism wherein the moving arrangement is a passive actuating arrangement configured to passively drive the element in the transverse direction.

The mechanism wherein the moving arrangement is an energy absorber, and/or where the energy absorber is one or more selected from a rubber absorber, pneumatic absorber and foam absorber.

A skilled person in the art will realise the base joints 130 may partly be integrally formed or connected with the base 500. Likewise, part of the attachment joints 150 may be integrally formed or connected to the attachment element 300.

The base 500, linkages 9, and frame 330 are generally composed of metal. The arms are likely to be cast.

Where in the foregoing description reference has been made to elements or integers having known equivalents, then such equivalents are included as if they were individually set forth.

Although the invention has been described by way of example and with reference to particular embodiments, it is to be understood that modifications and/or improvements may be made without departing from the scope or spirit of the invention.

The invention claimed is:

1. A mooring robot for releasably fastening a vessel to a dock or to a second vessel, the mooring robot comprising:

a) a base configured to attach to the dock or the second vessel;

b) an attachment element configured to releasably engage with a surface of the vessel; and c) at least two linkages dependent from the base and together supporting the attachment element and configured to retract and extend to allow movement of the attachment element in a transverse direction towards and away from the base respectively, each of the at least two linkages comprising a base arm and an attachment arm pivotably connected together at a revolute intermediate joint, the base arm pivotably connected to the base at a revolute base joint and the attachment arm pivotably connected to the attachment element at a revolute attachment joint, wherein the revolute intermediate joint, the revolute base joint and the revolute attachment joint define rotational axes that are spaced apart and parallel to each other, and wherein the rotational axes of the revolute intermediate joint, the revolute base joint and the revolute attachment joint of a first linkage of the at least two linkages are not parallel to rotational axes of the revolute intermediate joint, the revolute base joint and the revolute attachment joint of at least one second linkage of the at least two linkages.

2. The mooring robot as claimed in claim 1, wherein the mooring robot comprises a moving arrangement configured to extend and/or retract the attachment element in the transverse direction.

3. The mooring robot as claimed in claim 1, wherein the mooring robot comprises three, four, five, or six linkages.

4. The mooring robot as claimed in claim 1, wherein the robot comprises two linkages only, which include the first linkage and a second linkage.

5. The mooring robot as claimed in claim 4, wherein an angle between the rotational axis of the revolute intermediate joint of the first linkage is at 90 degrees to the rotational axis of the revolute intermediate joint of the second linkage, such that the rotational axes are orthogonal to each other.

6. The mooring robot as claimed in claim 1, wherein only the at least two linkages transfer a weight of the attachment element to the dock or the second vessel.

7. The mooring robot as claimed in claim 2, wherein the moving arrangement is a powered actuating arrangement.

8. The mooring robot as claimed in claim 7, wherein the moving arrangement is engaged between the base and one of the attachment arm or the attachment element.

9. The mooring robot as claimed in claim 1, wherein the attachment element comprises an engagement element configured to engage the surface of the vessel, and wherein the engagement element is a vacuum pad, a vacuum cup or cups, a hook device, a charging connection, or other engagement feature configured to releasably engage with the surface of the vessel.

10. The mooring robot as claimed in claim 1, wherein the base arm and the attachment arm of each of the at least two linkages are a same length as each other.

11. The mooring robot as claimed in claim 7, wherein the moving arrangement is an energy absorbing element.

12. The mooring robot as claimed in claim 1, wherein the base arm and/or the attachment arm of the at least two linkages have an L-shape, such that the base arm and/or the attachment arm generally curves inwardly at the respective revolute intermediate joint.

13. The mooring robot as claimed in claim 1, wherein at least one linkage of the at least two linkages is biased to retract the attachment element under gravity.

* * * * *